US006393238B1

(12) United States Patent
Hashimoto et al.

(10) Patent No.: US 6,393,238 B1
(45) Date of Patent: May 21, 2002

(54) IMAGE FORMING APPARATUS FEATURING A PARTICLE CARRYING CHARGING MEMBER AND A DEVELOPING DEVICE INCLUDING A MAGNETIC FIELD GENERATING DEVICE

(75) Inventors: Kouichi Hashimoto, Numazu; Atsushi Takeda, Mishima; Fumiteru Gomi, Shizuoka-ken; Yoshiyuki Komiya, Mishima, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/560,356

(22) Filed: Apr. 28, 2000

(30) Foreign Application Priority Data

Apr. 28, 1999 (JP) ..... 11-122179

(51) Int. Cl.[7] ..... G03G 15/02
(52) U.S. Cl. ..... 399/175
(58) Field of Search ..... 399/174, 175, 399/276, 277

(56) References Cited

U.S. PATENT DOCUMENTS 4,278,342 A * 7/1981 Andrew et al. ..... 399/169
4,597,661 A * 7/1986 Yamashita ..... 399/276
4,819,027 A * 4/1989 Murasaki et al. ..... 399/276 X
5,758,242 A * 5/1998 Malespin et al. ..... 399/277
5,970,285 A * 10/1999 Ito et al. ..... 399/175 X
6,061,539 A * 5/2000 Ishiyama et al. ..... 399/175
6,064,837 A * 5/2000 Hashimoto et al. ..... 399/175 X
6,118,952 A * 9/2000 Furuya ..... 399/175 X

FOREIGN PATENT DOCUMENTS

JP 8-106201 4/1996

* cited by examiner

*Primary Examiner*—Fred L Braun
(74) *Attorney, Agent, or Firm*—Fitzpatrick, Cella, Harper & Scinto

(57) ABSTRACT

An image forming apparatus includes an image bearing member and a charging device for electrically charging the image bearing member. The charging means includes a particle carrying member for receiving a charging bias voltage for carrying electroconducsctive magnetic particles. The particle carrying member is provided with an electrically insulated portion at an end portion within a region in which the magnetic particles are carried. An electrectrostatic image forming device forms an electrostatic image on the image bearing member charged by the charging device. A developing device develops the electrostatic image on the image bearing member. The developing device includes a developer carrying member for carrying a magnetic developer and a magnetic field generating device provided in the developer carrying member wherein the electrically insulating portion is outside a longitudinal end of the magnetic field generating device.

14 Claims, 10 Drawing Sheets

IMAGE FORMING APPARATUS FEATURING A PARTICLE CARRYING CHARGING MEMBER AND A DEVELOPING DEVICE INCLUDING A MAGNETIC FIELD GENERATING DEVICE

FIELD OF THE INVENTION AND RELATED ART

The present invention relates to an image forming apparatus such as a copying machine, a printer or the like using a electrophotographic process or electrostatic recording process.

Recently, a magnetic brush charging member having a magnetic brush portion which is magnetically confined on a carrying member (magnetic charging brush) is considered for use with a photosensitive member to which the magnetic brush is contacted to the photosensitive member to electrically charged it.

In the magnetic brush charger, electroconductive magnetic particles are confined directly to a magnet or combined on a sleeve containing a magnet therein. The magnetic brush is stationary or rotating and contacted to the photosensitive member, and the magnetic brush is supplied with a voltage by which an electric charge is injected into the photosensitive member to start charging.

In the injection charging system, the charge is directly injected into the photosensitive member from the contact charge member by which the surface of the photosensitive member is electrically charged. More particularly, a contact charge member having an intermediate resistance is contacted to the surface of the photosensitive member so that charge injection is effected directly into the surface of the photosensitive member. Therefore, even if the applied voltage to the contact charge member is lower than the discharge threshold, the photosensitive member can be charged to a potential equivalent to the applied voltage. The injection charging system does not produce ions.

However, the state of contact between the contact charge member and the photosensitive member is significantly influential to the charging performance. The contact charge member is desirably constituted at a high density, and the speed difference relative to the photosensitive member is desirably large so as to provide higher opportunity of the contact to the photosensitive member. In this sense, a magnetic brush charger is desirable as a charge member from the standpoint of the stability.

The injection charging using the magnetic brush charger is considered as being equivalent to a series circuit including a resistance and a capacitor. In an ideal charging process, the capacitor is charged at a point on the surface of the photosensitive member during the period of time in which the point is contacted to the magnetic brush (charging nip× peripheral speed) so that surface potential of the photosensitive member at the point becomes substantially the same as the applied voltage.

The injection charging type is less dependent on the ambience, and does not use electric discharge, and therefore, the applied voltage to the contact charge member is substantially as small as the required potential of the photosensitive member, and an additional advantage is that ozone is not produced, thus accomplishing completely ozoneless charging of low energy consumption. In an image forming apparatus of the contact charging type wherein the use is made with a magnetic brush charger comprising a magnetic particle carrying member for carrying magnetic particles and confining the particles thereon, and the magnetic brush portion of the magnetic brush charger is contacted to the photosensitive member (image bearing member), and wherein a charging bias is applied to electrically charge the photosensitive member, there is a problem of a deposition of the magnetic particles (charging carrier) constituting the magnetic brush of the magnetic brush charger (carrier deposition).

Referring to FIG. 5, the description will be made as to this problem. In the Figure, designated by 1 is a photosensitive drum as an image bearing member, 2A is a magnetic brush charger, 2*b* is an electroconductive charging sleeve as a magnetic particle carrying member in the magnetic brush charger, 2*c* is a magnetic brush portion of charging carrier 2*d* applied on the charging sleeve.

In the charging sleeve 2*b*, there is provided a magnet roller (unshown) functioning as a magnetic field generating member, and the magnet roller magnetically confines the charging carrier in the form of magnetic particles on the outer circumstantial surface of the charging sleeve 2*b* by the magnetic force of the magnet roller, so as to form a magnetic brush portion 2*c* of the charging carrier.

The magnetic brush portion 2*c* of the magnetic brush charger 2A is contacted to the surface of the photosensitive drum 1 to form a charging nip N.

In the magnetic brush charger 2A, the magnet roller in the charging sleeve 2*b* is not rotatable, and the charging sleeve 2*b* around the magnet roller is rotated at a predetermined peripheral speed in a predetermined direction. The photosensitive drum 1 is rotated in a predetermined direction at a predetermined peripheral speed. By the rotations of the charging sleeve 2*b* and the photosensitive drum 1, the outer surface of the photosensitive drum 1 is uniformly rubbed at the charging nip portion by the magnetic brush portion 2*c* of the magnetic brush charger 2A. The charging sleeve 2*b* receives a predetermined charging bias voltage from a charging bias applying voltage source not shown. By this, the outer surface of the photosensitive drum 1 which is rotating is charged uniformly to predetermined potential of a predetermined polarity. Designated by X is a region of a charging sleeve 2*b* which is coated with the charging carrier (a charging sleeve region in which the magnetic brush portion 2*c* exists); and Y is a region which is end sides of the charging sleeve of the region X and which is not coated with the charging carrier (a charging sleeve region in which the magnetic brush portion 2*c* does not exist).

At the boundary portion between the region X and the region Y, the potential of the photosensitive member abruptly changes, and therefore, the charging carrier deposition (end deposition of the charging carrier) from the magnetic brush charger 2A to the surface of the photosensitive drum 1 occurs at the boundary portion due to the potential difference. A method of avoiding this problem is disclosed in Japanese Laid-open Patent Application No. HEI 8-106201. As shown schematically in FIG. 5(*b*), the surface of the charging sleeve adjacent the end of the coated region is subjected to an insulating treatment 2*f* (a member for electrically insulating the charging carrier 2*d* from the developing sleeve 2*b*) so that change of the potential of the photosensitive member is less steep at the boundary portion, by which the carrier deposition can be prevented.

However, when the insulating 2*f* is broken or when the lateral current due to electric resistance increase of the charging carrier decreases, the charging carrier deposition is likely to occur again.

In the case that charging carrier 2*d* deposited on the photosensitive drum 1 is introduced into the developing device, the property of the developer is changed with the result that image forming operation becomes instable. Even when the developer is a two component type developer, the developing carrier has an electric resistance which is higher than the charging carrier, and therefore, the carrier for charging should be different from the carrier for development. If the charging carrier falls to the transferring device, the transfer bias voltage a leak with the result of transfer defect since the charging carrier has an electric resistance which is lower than the developer.

SUMMARY OF THE INVENTION

Accordingly, it is a principal object of the present invention to provide an image forming apparatus in which a possible damage of a developing device by charging particles is avoided.

It is another object of the present invention to provide an image forming apparatus in which a possible damage of a image transfer device by charging particles is avoided.

According to an aspect of the present invention, there is provided an image forming apparatus including an image bearing member; a charging means for electrically charging the image bearing member, the charging means including a particle carrying member for receiving a charging bias voltage and for carrying electroconductive magnetic particles, the particle carrying member being provided with an electrically insulated portion at an end portion within a region in which the magnetic particles are carried; electrostatic image forming means for forming an electrostatic image on the image bearing member charged by the charging means; and developing means for developing the electrostatic image on the image bearing member, the developing means including a developer carrying member for carrying a magnetic developer and a magnetic field generating means provided in the developer carrying member; wherein the electrically insulating portion is outside a longitudinal end of the magnetic field generating means.

These and other objects, features and advantage of the present invention will become more apparent upon a consideration of the following description of the preferred embodiments of the present invention taken in conjunction with the accompanying drawings.

DESCRIPTION OF THE PREFERRED EMBODIMENTS

Hereinafter, the preferred embodiments of the present invention will be described with reference to the appended drawings.

Figure 1:
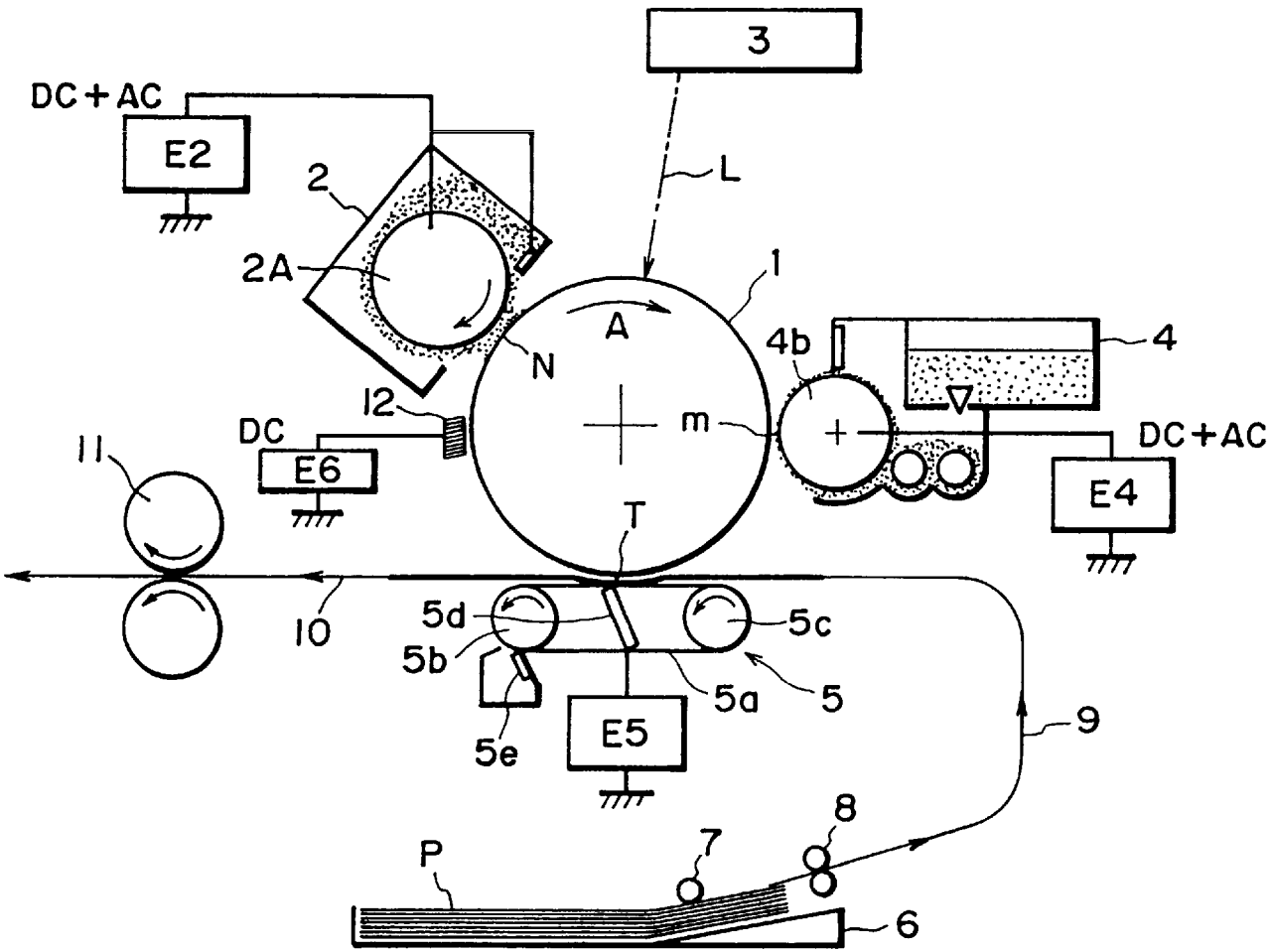
FIG. 1 is a schematic sectional view of the image forming apparatus in the first embodiment of the present invention, and depicts the general structure of the apparatus.

(1) Image Forming Apparatus (FIG. 1)

FIG. 1 is a schematic sectional view of an example of an image forming apparatus. The image forming apparatus in this embodiment is a laser beam printer which employs a transfer type electrophotographic process, a charge Injection type charging method, and a cleaner-less process.

A referential numeral 1 designates an electrophotographic photosensitive member (hereinafter, "photosensitive drum") in the form of a rotational drum, as an image bearing member. The photosensitive drum 1 in this embodiment is an OPC type photosensitive member (organic photoconductive photosensitive member), which is negatively charged by charge injection. It is rotatively driven at a process speed (peripheral velocity) of 150 mm/sec in the clockwise direction indicated by an arrow mark A.

A numeric referential code 2 designates a contact type charging apparatus for uniformly charging the peripheral surface of the photosensitive drum 1 to predetermined polarity and potential level. In this embodiment, it is a magnetic brush type charging apparatus, and the peripheral surface of the photosensitive drum 1 is uniformly charged to a potential level of approximately −700 V by this magnetic brush type charging apparatus which employs a charge injection type charging method, as the photosensitive drum 1 rotates.

A numeric referential code 3 designates an image data exposing means (exposing apparatus). In this embodiment, it is a laser beam scanner. This laser beam scanner 3 comprises a semiconductor laser, a polygon mirror, an F-θ lens, and the like, and projects a laser beam L modulated with sequential electrical digital picture element signals correspondent to image data of an image to be formed, which are inputted from an unillustrated host apparatus such as an original reading apparatus comprising photoelectric transducers such as a CCD, a computer, or a word processor, scanning the uniformly charged peripheral surface of the photosensitive drum 1. As the result of this exposure of the peripheral surface of the photosensitive drum 1 to the scanning laser beam L, an electrostatic latent image in accordance with the image data of the intended image is formed on the peripheral surface of the rotational photosensitive drum 1.

A numeric referential code 4 designates a developing apparatus. In this embodiment, the developing apparatus is of a type which employs a contact type developing method, and two component type developer, which comprises spherical nonmagnetic toner superior in mold releasing property, and magnetic carrier. With this developing apparatus, the electrostatic latent image on the peripheral surface of the rotational photosensitive drum 1 is developed in reverse into a toner image.

A numeric referential code 5 designates a transferring apparatus positioned below the photosensitive drum 1. In this embodiment, it is of a transfer belt type. An alphanumeric referential code 5*a* stands for an endless transfer belt as a transfer medium carrier (formed of, for example, 75 μm thick polyimide film). It is stretched around a driver roller 5*b* and a follower roller 5*c*, and is rotatively driven at an approximately the same peripheral velocity as the peripheral velocity of the photosensitive drum 1, in the same direction as the photosensitive drum 1. An alphanumeric referential code 5*d* designates an electrically conductive blade as a transfer charging device (transfer bias applying portion). It is disposed within the loop of the transfer belt 5*a*, in a manner to apply pressure to the transfer belt 5*a* so that the top side of the transfer belt 5*a* is kept pressed upon the downward side of the photosensitive drum 1, forming a transfer nip T as a transfer station. An alphanumeric referential code 5*e* designates a cleaning member disposed in contact with the transfer belt 5*a*. In this embodiment, it is in the form of blade (cleaning blade).

A numeric referential code 6 designates a sheet feeder cassette, in which transfer medium P such as a paper is stored. As a sheet feeder roller 7 is driven, the plural sheets of the transfer medium P stored in the sheet feeder cassette 6 are fed out of the cassette 6, while being separated one by one, and are fed into the transfer nip T, that is, the interface between the photosensitive drum 1 and the transfer belt 5*a* of the transfer apparatus 5, with a predetermined, controlled timing, through a sheet path 9 inclusive of a conveyer roller 8 or the like.

As the transfer medium P is carried to the transfer nip T, it is put through the interface between the rotational photosensitive drum 1 and transfer belt 5*a*, while being pinched by them. While the transfer medium P is put through the transfer nip T, a predetermined transfer bias is applied to the electrically conductive blade 5*d* from a transfer bias application electrical power source E5, to give the transfer medium P electrical charge opposite in polarity to the electrical charge of the toner. As a result, the toner image on the peripheral surface of the rotational photosensitive drum 1 is continually and electrostatically transferred onto the top side of the transfer medium P being passed through the transfer nip T.

After receiving the toner image as it was put through the transfer nip T, the transfer medium P is continually separated from the peripheral surface of the photosensitive drum 1, starting from the leading end, and is introduced into a fixing apparatus 11 (thermal roller type fixing apparatus, for example), through a sheet path 10. In the fixing apparatus 11, the toner image is fixed to the transfer medium P, and then, the transfer medium P is discharged from the image forming apparatus.

The toner particles which remained adhered to the surface of the transfer belt 5*a* are removed by the cleaning blade 5*e*.

The printer in this embodiment employs a cleaner-less process. More specifically, the printer is not provided with a dedicated cleaner for removing transfer residual toner particles, that is, the toner particles which remain on the surface of the rotational photosensitive drum 1 without being transferred onto the transfer medium P in the transfer nip T. Instead, the transfer residual toner particles reach the magnetic brush type charging apparatus 2 through the subsequent rotation of the photosensitive drum 1, as will be described later, and are temporarily recovered by the magnetic brush portion of the magnetic brush type charging device 2A, which is in contact with the photosensitive drum 1. After being temporarily recovered by the magnetic brush portion, the recovered toner particles are expelled back onto the peripheral surface of the photosensitive drum 1, and finally recovered by the developing apparatus 4. After the cleaning, the cleaned portion of the photosensitive drum 1 is repeatedly used for the following cycle of image formation.

A referential code 12 designates an electrically conductive brush as an auxiliary contact type charging member, which is placed in contact with the peripheral surface of the photosensitive drum 1, between the transferring apparatus 5 and magnetic brush type charging apparatus 2. To this electrically conductive brush 12, AC bias, DC bias opposite in polarity to the toner charge, or compound bias comprising AC bias and DC bias opposite in polarity to the toner charge, is applied, making uniform the peripheral surface of the photosensitive drum 1 in terms of the surface potential level, and at the same time, removing electrical charge from the transfer residual toner particles, that is, charging them opposite in polarity to that of the photosensitive drum 1; so that the residual toner particles are easily recovered by the magnetic brush portion of the magnetic brush type charging device 2A.

Figure 2:
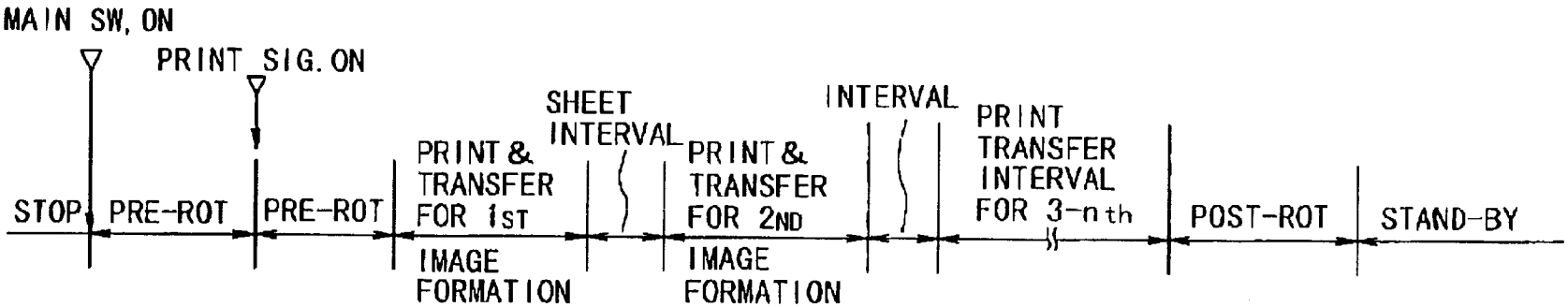
FIG. 2 is an operational sequence chart for the image forming apparatus.

(2) Operational Sequence of Printer (FIG. 2)

FIG. 2 is an operational sequence chart for the above described printer.

1) Preliminary Multiple Rotation Period

This is the period in which the printer is started up (start-up operation period, warming-up period), and in which the switch of the main power source is turned on to active the main motor of the apparatus, so that the photosensitive drum 1 begins to be rotationally driven to prepare the predetermined processing devices for a printing operation.

2) Preliminary Rotation Period

This is the period in which the preliminary operation is performed. If a print signal is inputted during the preliminary multiple rotation stage, this preliminary rotation period is carried out immediately after the preliminary multiple rotation period is completed. If no print signal is inputted, the driving of the main motor is temporarily stopped after the completion of the preliminary multiple rotational period, stopping he rotational driving of the photosensitive drum, so that the printer is kept on standby until a print signal is inputted. As a print signal is inputted, the preliminary rotation stage is initiated.

3) Printing Period (Image Formation Period, Image Making Period)

As soon as the predetermined preliminary rotation period is completed, a process for forming an image on the rotational photosensitive drum is immediately started, and then, the toner image formed on the peripheral surface of the rotational photosensitive drum is transferred onto transfer medium. Then, the toner image is fixed to the transfer medium by a fixing means, and finally, the transfer medium, on which an image has been fixed, or a copy, is outputted.

When in a continuous printing mode, the above described printing process is repeated n times, the value of which is the same as the number of copies to be made.

4) Interval Periods

These period are the interval periods in a continuous printing mode, that is, the interval periods from when the trailing end of a sheet of transfer medium passes the transfer nip portion to when the leading end of the following sheet of transfer medium reaches the transfer nip portion; in other words, they are periods in which no transfer medium is passing through the transfer nip portion.

5) Post-Printing Rotation Period

This period is the period after the n-th printing process, or the last printing process, in which the driving of the main motor is continued to rotationally drive the photosensitive drum to carry out predetermined post-printing operations.

6) Standby Period

As the predetermined post-printing operations are competed, the driving of the main motor is stopped to stop the rotational driving of the photosensitive drum, and thereafter, the printer is kept on standby until the following print-starting signal is inputted.

When in a single copy mode, after the printing of a single copy, the printer assumes the standby state after performing the post-printing rotation process.

If a start signal is inputted while the printer is on standby, the printer starts the preliminary rotation.

Period 3) is the image formation period, whereas Periods 1), which is the multiple preliminary rotation period, Period 2), which is the preliminary rotation period, Period 4), which is the interval period, and Period 5), which is the post-printing rotation period, are the periods in which no image are formed.

Figure 3:
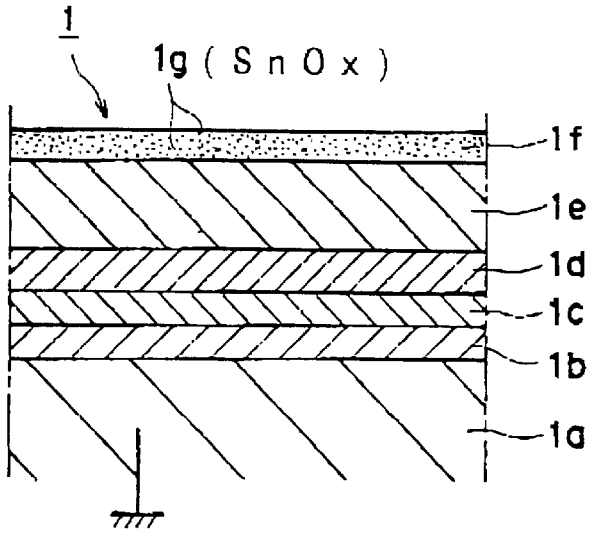
FIG. 3 is a schematic sectional view of a photosensitive member, showing the laminar structure of the member.

(3) Photosensitive Drum 1 (FIG. 3)

As described above, the photosensitive drum 1 in this embodiment is an OPC based photosensitive member which is negatively charged by charge injection. As is shown in FIG. 3, which is a schematic sectional view of the laminar portion of the photosensitive drum 1, the photosensitive drum 1 comprises an aluminum base 1*a* in the form of a drum with a diameter of 30 mm, and the first to fifth functional layers 1*b* to if, counting from the innermost side, placed in layers on the peripheral surface of the aluminum base member 1*a*.

The first layer 1*b* is an undercoat layer, which is an electrically conductive layer with a thickness of approximately 20 $\mu$m, provided to smoothing the peripheral surface of the aluminum base 1*a* in the form of a drum, by compensating for the surface defects, and also to prevent the occurrence of the moire, the cause of which is the reflection of the exposing laser beam.

The second layer 1*c* is a layer for preventing positive charge from being injection. It assumes the role of preventing the positive charge injection from the aluminum base drum 1*a*, from cancelling the negative charge given to the peripheral surface of the photosensitive drum. It is an approximately 1 $\mu$m thick layer formed of Amylan and methoxy-methyl-nylon, and its electrical resistance has been adjusted to a value in the medium range: approximately $10^6$ ohm.cm.

The third layer 1*d* is a charge generation layer, which is an approximately 0.3 $\mu$m thick layer in which dis-azoic pigment has been dispersed. As this third layer 1*d* is exposed to the laser beam, negative-positive charge pairs are generated in the layer.

The fourth layer 1*e* is a charge transfer layer. It is a layer of polycarbonate resin, in which hydrazone has been dispersed. It is a P-type semiconductor layer. Therefore, the negative charge given to the peripheral surface of the photosensitive drum cannot transfer through this layer; only the positive charge generated in the charge generation layer 1*d* can be transferred into the surface layer of the photosensitive drum.

The fifth layer 1*f* is a charge injection layer, which is an approximately 3 $\mu$m thick coated layer with relatively low electrical resistance. More specifically, antimony, which is photo-transmissive and electrically conductive filler, is doped with tin oxide ($SnO_2$) to reduce its electrical resistance, and this mixture is formed into particles with a diameter of 0.03 $\mu$m. Then, one gram of these microscopic particles is dispersed into photo-hardening acrylic resin, as binder, as a weight percent ratio of 1:70. Then, this mixture is coated to a thickness of approximately 3 $\mu$m. The electrical resistance value of this charge injection layer 1*f* needs to be in a range of $1\times10^{10}$–$1\times10^{14}$ ohm.cm, in which the photosensitive drum is satisfactorily charged, and "image flow" does not occur. In this embodiment, a photosensitive drum with a surface resistance of $1\times10^{13}$ was employed.

(4) Magnetic Brush Type Charging Apparatus (FIGS. 4–7)

Figure 4:
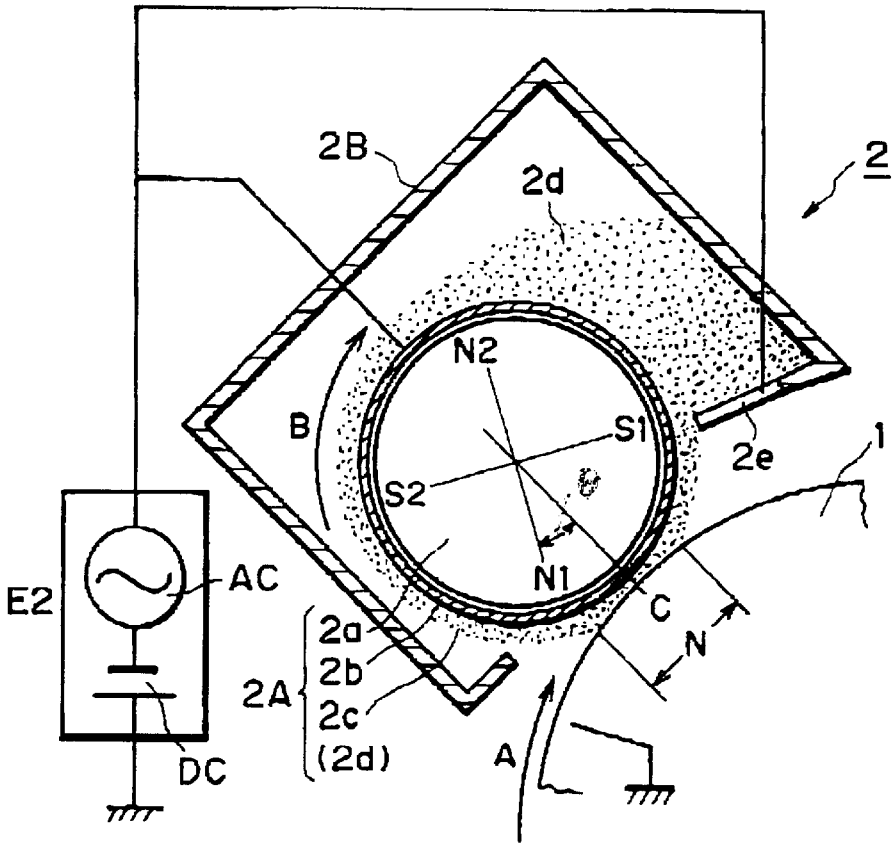
FIG. 4 is an enlarged schematic sectional view of a magnetic brush type charging apparatus.

FIG. 4 is an enlarged schematic sectional view of the magnetic brush type charging apparatus 2. Roughly speaking, the magnetic brush type charging apparatus 2 in this embodiment comprises a magnetic brush type charging member 2A (magnetic brush type charging device), a housing 2B in which the magnetic brush type charging device 2A and electrically conductive magnetic particles 2*d* (charge carrier) are stored, an electrical power source E2 for applying charge bias to the magnetic brush type charging device 2A, and the like.

The magnetic brush type charging device 2A in this embodiment is of a sleeve rotation type, and comprises: a magnetic roll 2*a* (magnet); an electrically conductive and nonmagnetic stainless steel sleeve 2*b* (called an electrode sleeve, an electrically conductive sleeve, a charge sleeve, or the like) fitted around the peripheral surface of the magnetic roll; and a magnetic brush portion 2*c*, that is, a body of charge carrier 2*d* confined in the shape of a brush by the magnetic force of the magnetic roll 2*a* within the sleeve, on the peripheral surface of the sleeve 2*b*.

The magnetic roll 2*a* is a non-rotational fixed member. The charge sleeve 2*b* is fitted around the peripheral surface of this magnetic roll 2*a* and is rotatively driven in the clockwise direction indicated by an arrow mark B by an unillustrated driving system, at a predetermined peripheral velocity, which is 225 mm/sec in this embodiment. The charge sleeve 2*b* is disposed with the use of such means as spacer rollers so that an approximately 500 $\mu$m wide gap is provided between the peripheral surface of the charge sleeve 2*b* and the photosensitive drum 1.

An alphanumeric referential code 2*e* designates a non-magnetic stainless blade for regulating the thickness of the magnetic brush layer. It is disposed so that a gap of 900 $\mu$m is provided between the blade 2*e* and the peripheral surface of the charge sleeve 2*b*.

A portion of the charge carrier 2*d* in the housing 2B is held on the peripheral surface of the charge sleeve 2*b*, being confined in the form of a brush, as the magnetic brush portion 2*c*, by the magnetic force of the magnetic roll 2*b* in the sleeve. As the charge sleeve 2*b* is rotatively driven, the magnetic brush portion 2*c* rotates in the same direction as the charge sleeve 2*c*, together with the charge sleeve 2*b*. As the magnetic brush portion 2*c* rotates, its thickness is rendered uniform to a predetermined thickness, which is greater than the gap between the charge sleeve 2*b* and the peripheral surface of the photosensitive drum 1. Thus, the magnetic brush portion 2*e* makes contact with the peripheral surface of the photosensitive drum 1, forming a nip with a predetermined width, at where the distance between the peripheral surfaces of the charge sleeve 2*b* and photosensitive drum 1 is smallest. This contact nip portion constitutes a charge nip portion N. Therefore, the rotational photosensitive drum 1 is rubbed in the charge nip portion N by he magnetic brush portion 2*c*, which rotates as the charge sleeve 2*b* of the magnetic brush type charging device 2A rotates. In this case, in the charging nip portion N, the moving directions of the peripheral surfaces of the photosensitive drum 1 and magnetic brush portion 2*c* are opposite to each other, contributing to the increase in their peripheral velocity relative to each other.

To the charge sleeve 2*b* and magnetic brush layer thickness regulation blade 2*e*, predetermined biases are applied, respectively, form the electrical power source E2.

Thus, as the photosensitive drum 1 is rotatively driven; the charge sleeve 2*b* of the magnetic brush type charging device 2A is rotatively driven; and the predetermined biases are applied from the electrical power source E2, the peripheral surface of the rotational photosensitive drum 1 is uniformly charged to predetermined polarity and potential level by a contact type charging method, which, in this embodiment, is a charge injection method.

Figure 5:
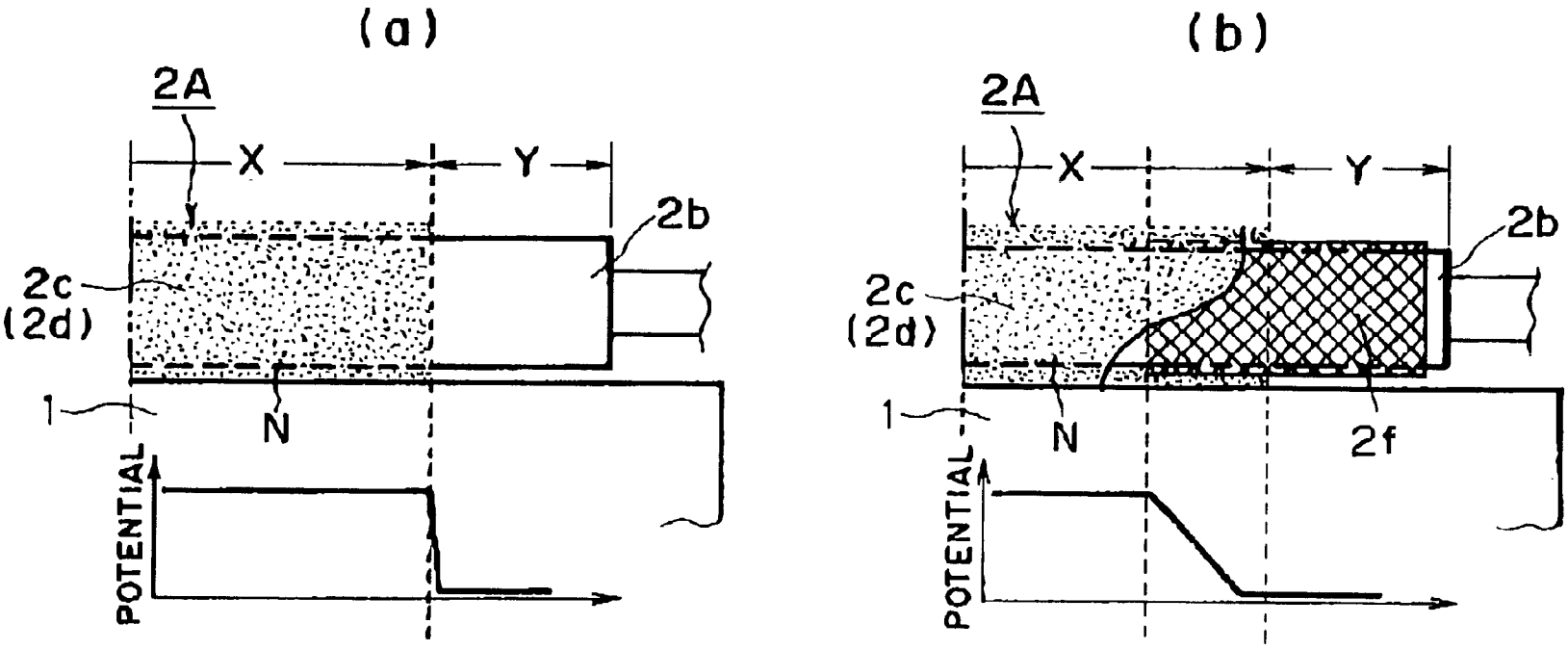
FIG. 5(*a*) is a drawing illustrating the adhesion of a change carrier to an image bearing member and FIG. 5(*b*) is a drawing illustrating the prevention of the adhesion of the changes carrier to the image bearing member.

Further, in the case of the magnetic brush type charging apparatus 2*b* in this embodiment, the surface of the charge sleeve 2*b* is given an electrically insulative treatment 2*f* (member for electrically insulating between the charge sleeve 2*b* and charge carrier 2*d*), across the adjacencies of the end of the area to be coated with the carrier, as shown in FIG. 5(*b*), that is, the above-described schematic drawing, so that the change in the potential level of the photosensitive drum, at the border portion between a region X of the charge sleeve 2*b*, which is coated with the charge carrier (charge sleeve region across which the magnetic brush portion 2*c* is present), and a region Y, which is closer to the end of the charge sleeve 2*b* than the region X, and is not coated with the charge carrier (charge sleeve region across which the magnetic brush portion is not present), becomes gradual enough to prevent the charge carrier from adhering to the adjacency of the end of the photosensitive drum 1.

The magnetic roll 2*a* is fixedly disposed in the charge sleeve 2*b* so that the angle formed by the line connecting the axis of the charge sleeve 2*b* and its magnetic pole N1 (primary pole) with a magnetic force of approximately 900 G, and the line connecting a point C, at which the gap between the peripheral surfaces of the photosensitive drum and charge sleeve 2*b* is smallest, and the axis of the charge sleeve 2*b*, becomes approximately 10 degrees.

The magnetic roll 2*a* is desired to be angled in terms of its circumferential direction so that the angle formed by the line connecting the axis of the charge sleeve 2*b* and its magnetic pole N1 (primary pole) with a magnetic force of approximately 900 G, and the line connecting a point C, at which the gap between the peripheral surfaces of the photosensitive drum and charge sleeve 2*b* is smallest, and the axis of the charge sleeve 2*b*, falls in a range from 20 degrees in the upstream direction, in terms of the rotational direction of the photosensitive drum, from the line connecting the point C and the axis of the charge sleeve 2*b*, to 10 degrees in the downstream direction from the line connecting the point C and the axis of the charge sleeve 2*b*, preferably 0 to 15 degrees toward upstream. If the angle is wider in the downstream direction beyond the above described range, the charge carrier is attracted by the primary pole position, making it easier for the carrier to collect on the downstream side relative to the charge nip portion N in terms of the rotational direction of the photosensitive drum, whereas the angle is wider in the upstream direction beyond the aforementioned range, it becomes difficult for the charge carrier to be conveyed forward after passing the charging nip portion N, making the charge carrier to collect.

Further, when no magnetic pole is present in the charging nip portion N, the force which acts on the charge carrier in a manner to hold the charge carrier on the peripheral surface of he charge sleeve is weak, making it easier for the charge carrier to adhere to the photosensitive drum 1, which is obvious.

The charging nip portion N described here means the region across which the charge carrier in the magnetic brush portion 2*c* is in contact with the photosensitive drum 1 during the charging period.

The charge bias is applied to the charge sleeve 2*b* and regulator blade 2*e* by the electrical power source E2. In this embodiment, compound bias comprising DC component and AC component is used as the charge bias.

As the peripheral surface of the photosensitive drum 1 is rubbed by the magnetic brush portion 2*c* of the magnetic brush type charging device 2A, and the charge bias is applied to the magnetic brush type charging device 2A, electrical charge is given to the peripheral surface of the photosensitive drum 1 from the charge carrier 2*d*, which are forming the magnetic brush portion 2*c*. As a result, the peripheral surface of the photosensitive drum 1 is uniformly charged to the predetermined polarity and potential level. In this embodiment, the photosensitive drum 1 is provided with the charge injection layer 1*f* as the surface layer, and therefore, the photosensitive drum 1 is charged by charge injection. In other words, the peripheral surface of the photosensitive drum 1 is charged to the potential level correspondent to the DC component of the compound bias (DC+AC). There is a tendency that the faster the peripheral velocity of the charge sleeve 2*b*, the better charged is the photosensitive drum 1 in terms of charge uniformity.

Figure 6:
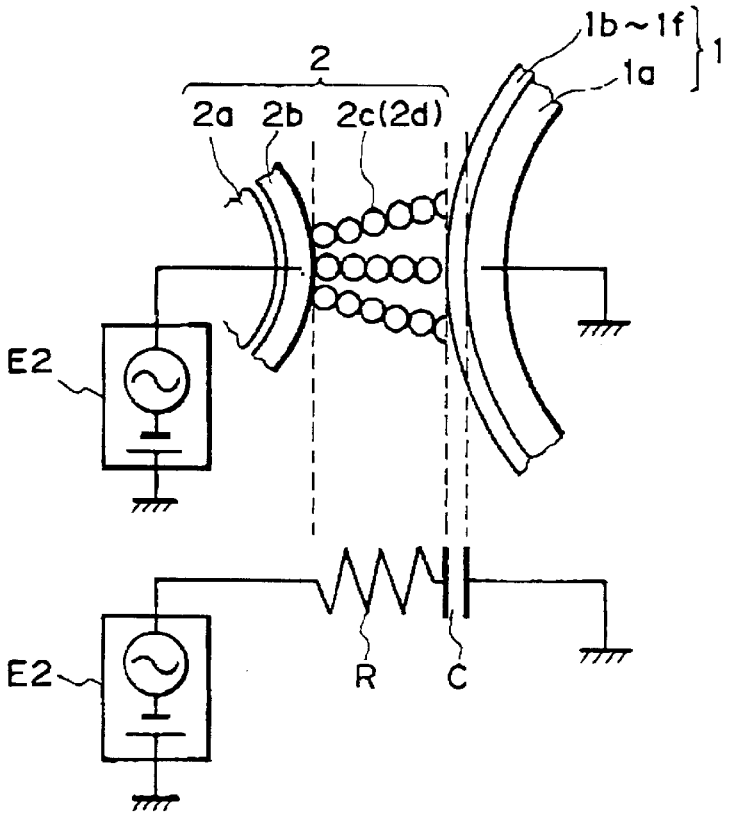
FIG. 6 is an equivalent circuit diagram of a charging circuit.

The injection of electrical charge into the photosensitive drum 1 by the magnetic brush type charging device 2A may be viewed as the operation of a circuit composing a resistor R and a condenser C such as the equivalent circuit in FIG. 6. In the case of this kind of circuit, the surface potential level Vd of the photosensitive drum can be expressed by the following formula (1):

$$Vd=V_0(1-\exp(t_0/(Cp.r) \quad (1)$$

r: resistance value; Cp: electrostatic capacity of photosensitive drum: $V_0$: applied voltage; $t_0$: charging time (time necessary for a given point on the peripheral surface of the photosensitive drum to pass the charge nip portion N)

In the charge bias (DC+AC), the DC component was given the same value as the value of the necessary surface potential level of the photosensitive drum 1, which in this embodiment was −700 V.

It is desired that the peak-to-peak voltage Vpp of the AC component during image formation is no less than 100 V and no more than 2,000 V, preferably no less than 300 V and no more than 1,200 V. If the peak-to-peak voltage Vpp is below the above range, the effectiveness of the voltage as the charge bias is weak in terms of the charge uniformity and improvement in the start-up of the potential level, whereas if the peak-to-peak voltage Vpp is above the above range, the voltage is inferior in terms of the carrier collection and carrier adhesion to the photosensitive drum.

As for the frequency, it is desired to be no less than 100 Hz and no more than 5,000 Hz, preferably no less than 500 Hz and no more than 2,000 Hz. If the frequency is below the above range, the voltage is less effective as the charge bias in terms of the adhesion of the carrier to the photosensitive drum, charge uniformity, and improvement in the start-up of the potential level. On the other hand, if the frequency is higher than the above range, the voltage is also less effective in terms of the charge uniformity, and improvement in the start-up of the potential level.

The waveform of the AC component may be rectangular, triangular, sinusoidal, or the like.

As for the charge carrier 2*d* for forming the magnetic brush portion 2*c*, in the case of this embodiment, charge carrier obtained by reducing sintered ferromagnetic material (ferrite) was used. However, other charge carrier can be employed equally effectively, for example, charge carrier manufactured by pulverizing the kneaded mixture of resin and ferromagnetic material, charge carried obtained by mixing electrically conductive carbon or the like into the preceding charge carrier to adjust the electrical resistance value, charge carrier obtained by given the surface treatment to the preceding carrier.

The charge carrier 2*d* for forming the magnetic brush portion 2*c* must be able to carry out two roles: the role of satisfactorily injecting electrical charge into the traps of the surface of the photosensitive drum, and the role of preventing the charging member and photosensitive drum from being damaged by the concentration of the charge current to the pinholes or the like, which occur at the surface of the photosensitive drum.

Therefore, the electrical resistance value of the magnetic brush type charging device 2A is desired to be in a range of $1\times10^4$–$1\times10^9$ ohm, preferably $1\times10^4$–$1\times10^7$ ohm. If the resistance value of the magnetic brush type charging device 2A is no more than $1\times10^4$ ohm, it is likely that the pinhole leak will occur, whereas if it is greater than $1\times10^9$ ohm, it is likely to be difficult to satisfactorily inject electrical charge. Further, for the purpose of keeping the resistance value within the above range, it is desired that the volumetric resistivity value of the charge carrier 2*d* is within a range of $1\times10^4$–$1\times10^9$ ohm, preferably $1\times10^4$–$1\times10^7$ ohm.

The resistance value of the magnetic brush type charging device 2A employed in this embodiment wax $1\times10^6$ ohm, and as a voltage of −700 V was applied as the DC component of the charge bias, the surface potential level of the photosensitive drum also becomes −700 V.

Figure 7:
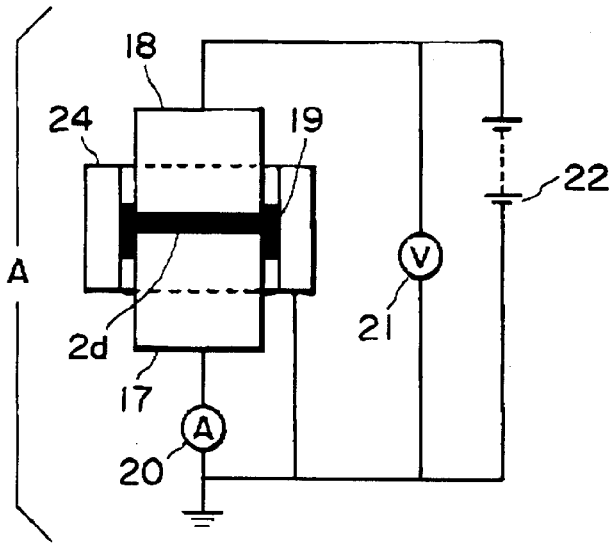
FIG. 7 is a drawing for describing the gist of a method for measuring the electrical resistance value of the charge carrier (volumetric resistivity value).

Outlining briefly, the volumetric resistivity value of the charge carrier 2*d* was measured using the method depicted in FIG. 7. In other words, the charge carrier 2*d* was packed in a cell A, and a main electrode 17 and a top side electrode 18 were disposed so that they made contact with the packed charge carrier 2*d*. Then, voltage was applied between the two electrodes 17 and 18 from a constant voltage power source 22, and the current, which flowed while the voltage was applied, was measured to obtain the volumetric resistivity value of the charge carrier 2*d*. Numeric referential codes 19, 21 and 24 designate a piece of insulative material, a voltmeter, and guide ring, correspondingly.

As for the condition under which the measurement was carried out, the temperature was 23° C. and the humidity was 65%. As for the specifications of the components involved in the measurement, the size S of the contact area between the packed charge carrier 2*d* and the cell was 2 $cm^2$, and the thickness d was 1 mm. The amount of the load placed upon the top side electrode 18 was 10 kg, and the value of the applied voltage was 100 V.

From the viewpoint of presenting the charging frequency from being reduced by the contamination of the particle surface, the average particle diameter of the charge carrier, and the peak of the particle size distribution, are desired to be in a range of 5–100 $\mu$m.

The average particle diameter of the charge carrier 2*d* is represented by the maximum chord length in the horizontal direction. As for the method for obtaining the average particle length, no more than 300 particles of the charge carrier 2*d* are randomly selected and are actually measured in diameter. Then, their diameters are arithmetically averaged.

Figure 8:
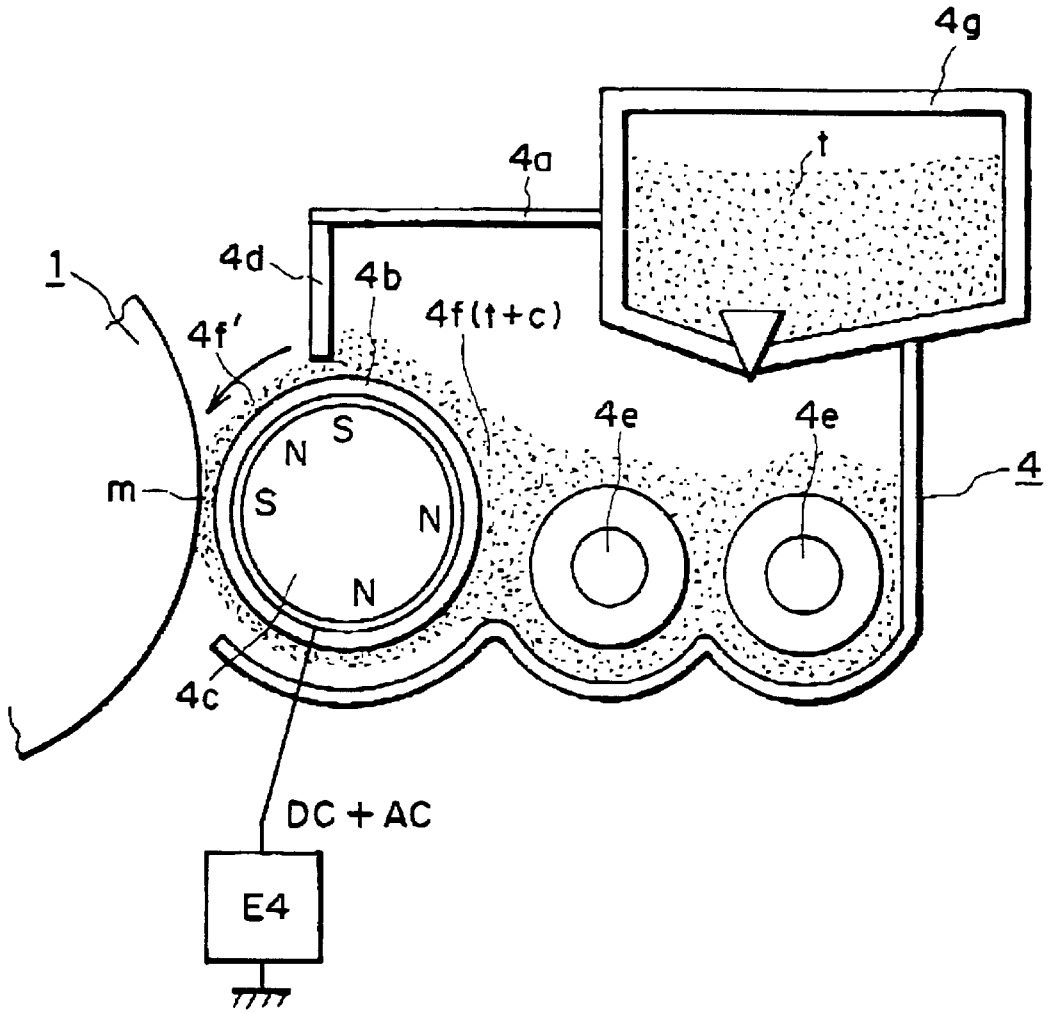
FIG. 8 is an enlarged sectional view of a developing apparatus.

(5) Developing Apparatus 4 (FIG. 8)

The methods for developing an electrostatic latent image with the use of toner can generally be divided into the following four categories.

a. A developing method in which an electrostatic latent image is developed with nonmagnetic toner coated on a sleeve by a blade or the like, or magnetic toner coated on a sleeve with the use of magnetic force, without direct contact between the toner layer and a photosensitive drum (single component, noncontact development).

b. A developing method in which the toner coated as described above is placed in contact with a photosensitive drum to develop an electrostatic latent image (single component contact development).

c. A developing method in which mixture of toner particles and magnetic carrier is used as developer, and this developer is conveyed with the use of magnetic force to be placed in contact with a photosensitive drum to develop an electrostatic latent image (two component contact development).

d. A developing method in which the above described two component developer is used in a noncontact manner to develop an electrostatic latent image (two component noncontact development).

Among those methods, the two component contact development method (c) is more frequently and widely used, in consideration of image quality and image stability.

FIG. 8 is an enlarged schematic sectional view of the developing apparatus 4 used in this embodiment. The developing apparatus 4 in this embodiment is such a developing apparatus that uses two component magnetic developer, which forms a magnetic brush, a contact type developing method, and a reversal developing method. More specifically, it uses developer manufactured by mixing nonmagnetic spherical toner superior in mold releasing property, with magnetic carrier (development charge carrier, development carrier). This developer is carried on a developer bearing member (developing member, developing device), being confined in the form of a magnetic brush layer by the magnetic force, and is conveyed to a development station, in which the developer is placed in contact with the peripheral surface of the photosensitive drum, to develop an electrostatic latent image into a toner image.

Alphanumeric referential codes 4*a*, 4*b* and 4*c* designate a developing means housing, a development sleeve as a developer bearer, and a magnet (magnetic roll) as a magnetic field generating means fixedly disposed within the development sleeve 4*b*, correspondingly. Referential codes 4*d*, 4*e* and 4*f* designate a developer layer thickness regulator blade for forming a thin layer of developer on the peripheral surface of the development sleeve, a screw for stirring and conveying developer, and two component developer stored in the developing means housing 4*a*, correspondingly. The two component developer is a mixture of nonmagnetic toner t and developer carrier c as described above.

The development sleeve 4*b* is disposed so that at least during development, the distance (gap) between the peripheral surfaces of the development sleeve 4*b* and photosensitive drum 1 becomes approximately 500 $\mu$m, at a point where the distance between the two surfaces is smallest, and the magnetic brush, that is, the thin layer 4*f'* of the developer borne on the peripheral surface of the development sleeve 4*b*, makes contact with the peripheral surface of the photosensitive drum 1. This contact nip m between the magnetic brush 4*f'*, that is, the magnetic brush, and the photosensitive drum 1 constitutes a development region (development station).

The development sleeve 4*b* is rotatively driven around the peripheral surface of the stationary magnet 4*c* within the development sleeve 4*b*, in the counterclockwise direction indicated by an arrow mark, at a predetermined peripheral velocity. As the development sleeve 4*b* is rotated, the magnetic brush, that is, the layer of developer 4*f*(t+c), is formed on the peripheral surface of the development sleeve 4*b* by the magnetic force of the stationary magnet 4*c*, within the developing means housing 4*a*. As the development sleeve 4*b* is further rotated, the magnetic brush, or the developer layer, is conveyed and is regulated in thickness, becoming the thin developer layer 4*f'* with a predetermined thickness, that is, the magnetic brush, is carried out of the developing means housing, is conveyed further to the development portion m, and makes contact with the peripheral surface of the photosensitive drum 1. Then, as the development sleeve 4*b* is further rotated, the developer layer 4*f'* returns to the developing means housing 4*a*. The sleeve 4*b* is rendered longer than the magnet 4*c*.

To the development sleeve 4*b*, a predetermined compound development bias comprising DC component and AC component is applied from a development bias application electrical power source E4. The development process in this embodiment was characterized in that if the difference in voltage value between the potential level (−700 V) of the charged photosensitive drum 1 and the DC component of the development bias was no more than 200 V, fog occurred, whereas if the difference was no less than 350 V, the development carrier c adhered to the photosensitive drum 1. Therefore, the value of the DC component of the development bias was set at −400 V.

The toner density (mixing ratio of the toner to the developer carrier c of the developer 4*f*(t+c) within the developing means housing 4*a* gradually reduces as the toner is consumed for the electrostatic latent image development. Thus, the toner density of the developer 4*f* in the developing means housing 4*a* is detected by an unillustrated detecting means, and as the toner density reduces to a predetermined minimum tolerance limit, the developer 4*f* in the developing means housing 4*a* is replenished with the toner t from a toner replenishment portion 4*g*, to keep the toner density of the developer 4*f* in the developing means housing 4*a*, within a predetermined tolerance range.

(6) Cleaner-less Process

The printer in this embodiment uses a cleaner-less process. In other words, it does not have a dedicated cleaner for removing the toner particles remaining on the peripheral surface of the rotational photosensitive drum 1 without being transferred onto the transfer medium in the transfer nip portion T. Thus, the transfer residual toner particles are carried to the position of the magnetic brush type charging apparatus 2 by the rotation of the photosensitive drum 1 subsequent to the image transfer, and are temporarily recovered by the magnetic brush portion of the magnetic brush type charging device 2A as the contact type charging member in contact with the photosensitive drum 1. Thereafter, the recovered toner particles are expelled back onto the peripheral surface of the photosensitive drum 1, and then, are finally recovered by the developing apparatus 4. The cleaned portion of the photosensitive drum 1 is repeatedly used for image formation.

The toner is subjected to electrical discharge or the like which occurs during image transfer, and therefore, more often than not, the transfer residual toner on the photosensitive drum 1 is a mixture of positively charged toner particles and negatively charged toner particles. In this embodiment, this transfer residual toner with mixed polarity is charged to the normal polarity (negative in this embodiment), becoming uniform in polarity, while the transfer residual toner passes by the electrically conductive roller 12 as the second charging member. Then, as the transfer residual toner rectified in polarity reaches the magnetic brush type charging device 2A, which is the first charging member, it is temporarily mixed into, that is, recovered by, the magnetic brush portion 2*c*. This process of mixing the rectified transfer residual toner into the magnetic brush portion 2*c* of the magnetic brush type charging device 2A can be enhanced by applying AC voltage to the magnetic brush type charging device 2A so that an oscillating electrical field is created between the magnetic brush type charging device 2A and photosensitive drum 1.

As the transfer residual toner is mixed into the magnetic brush portion 2*c*, all the toner particles in the transfer residual toner are charged to negative polarity, and then, are expelled back onto the photosensitive drum 1. Next, the transfer residual toner, all the particles of which have been uniformly charged to negative polarity is carried to the development portion m, where it is recovered into the developing device 4*b* of the developing apparatus 4 by the fog removal electrical field, at the same time as an electrostatic latent image is developed; in other words, the transfer residual toner is removed at the same time as an electrostatic latent image is developed.

In an image forming apparatus in which the length of an image being formed, in terms of the rotational direction of the photosensitive drum 1, is greater than the circumference of the photosensitive drum 1, this recovery of the transfer residual toner simultaneous with the development of an electrostatic latent image is carried out at the same time as the other image formation processes: charging, exposing, developing, and transferring processes.

In other words, the transfer residual toner is recovered by the developing apparatus 4 and is used in the following image forming cycle and thereafter. Therefore, no waste toner is produced. Further, this cleaner-less process is beneficial from the viewpoint of space usage, greatly contributing to the reduction of image formation apparatus size.

With the use of spherical toner with a high degree of mold releasing property, as toner t of the developer, which is manufactured by polymerization, the amount by which the transfer residual toner is generated can be reduced, and also, the recoverableness of the toner expelled from the magnetic brush type charging device 2A, into the developing apparatus 4 can be improved. Further, the recoverableness of the toner expelled from the magnetic brush type charging device 2A is also improved with the use of the developing apparatus 4 which employs a two component contact type developing method.

The toner expelled from the magnetic brush portion 2*c* onto the photosensitive drum 1 is in an extremely uniformly scattered state, and its amount is extremely small. Therefore, it does not occur that the expelled toner has a substantial amount of harmful effect upon the image exposure process in the following image formation cycle. Further, it does not occur that a ghost image reflecting the transfer residual toner pattern is formed.

Normally, the toner is relatively high-in electrical resistance. Therefore, the mixture of the toner particles with such a property into the magnetic brush portion 2*c* of the magnetic brush type charging device 2A becomes one of the causes which increase the electrical resistance of the magnetic brush portion 2*c*, that is, the causes which reduce the charging performance of the magnetic brush portion 2*c*. When the amount of the toner which has been mixed into the magnetic brush portion 2*c* is relatively large, the charging performance can be restored to a satisfactory level by causing a large amount of toner to be expelled during the periods in which no image is formed.

Thus, in this embodiment, during the sheet intervals, which are not image formation periods, the application of the AC component of the charge bias to the magnetic brush type charging device 2A is interrupted to increase the difference δV in potential level between the peripheral surface of the photosensitive drum and the voltage applied, while a given area of the peripheral surface of the rotational photosensitive drum 1 passes the charging nip portion before passing the transfer nip portion T, so that a large amount of toner is expelled from the magnetic brush portion 2*c* of the magnetic brush type charging device 2A, to keep the amount of the toner in the magnetic brush portion 2*c* constant at a level below the predetermined level, for he purpose of controlling the increase in the electrical resistance of the magnetic brush, for an extend period of time.

(7) Countermeasure to Adhesion of Charge Carrier to End Portions

In this embodiment, the magnetic brush type charging apparatus 2 is given an insulative treatment 2*f* (FIG. 5(*b*)) as a member for electrically insulate between the charge sleeve 2*b* and charge carrier 2*d*, in order to prevent the charge carrier from adhering to the end portion of the photosensitive drum 1. More specifically, this insulative treatment 2*f* is given to the peripheral surface of charge sleeve 2*b*, across the outward portion of the area to be coated by the charge carrier, in terms of the horizontal direction of the charge sleeve 2*b*, and the longitudinal end portion of the charge sleeve 2*b*.

Even with the provision of this insulative treatment 2*f*, however, there is still a possibility that the treatment 2*f* across the end portion of the charge sleeve 2*b* breaks, or the amount of the lateral current flow is reduced by the increase of the electrical resistance of the charge carrier 2*d*, allowing the carrier to adhere.

Thus, in this embodiment, a countermeasure is taken, assuming that the above described incident will occur. More specifically, in order to prevent the developing apparatus 4 and transferring apparatus 5 from being damaged by the charge carrier which has adhered to the longitudinal end portions of the photosensitive drum 1, the relationship in terms of width (relationship in terms of the measurement in the direction perpendicular to the direction in which recording paper is conveyed) among the magnetic brush type charging device 2A of the charging apparatus 2, the development sleeve 2*b* of the developing apparatus 4, the transfer belt 5*a* of the transferring apparatus 5, and the like was set as shown in FIG. 9.

Figure 9:
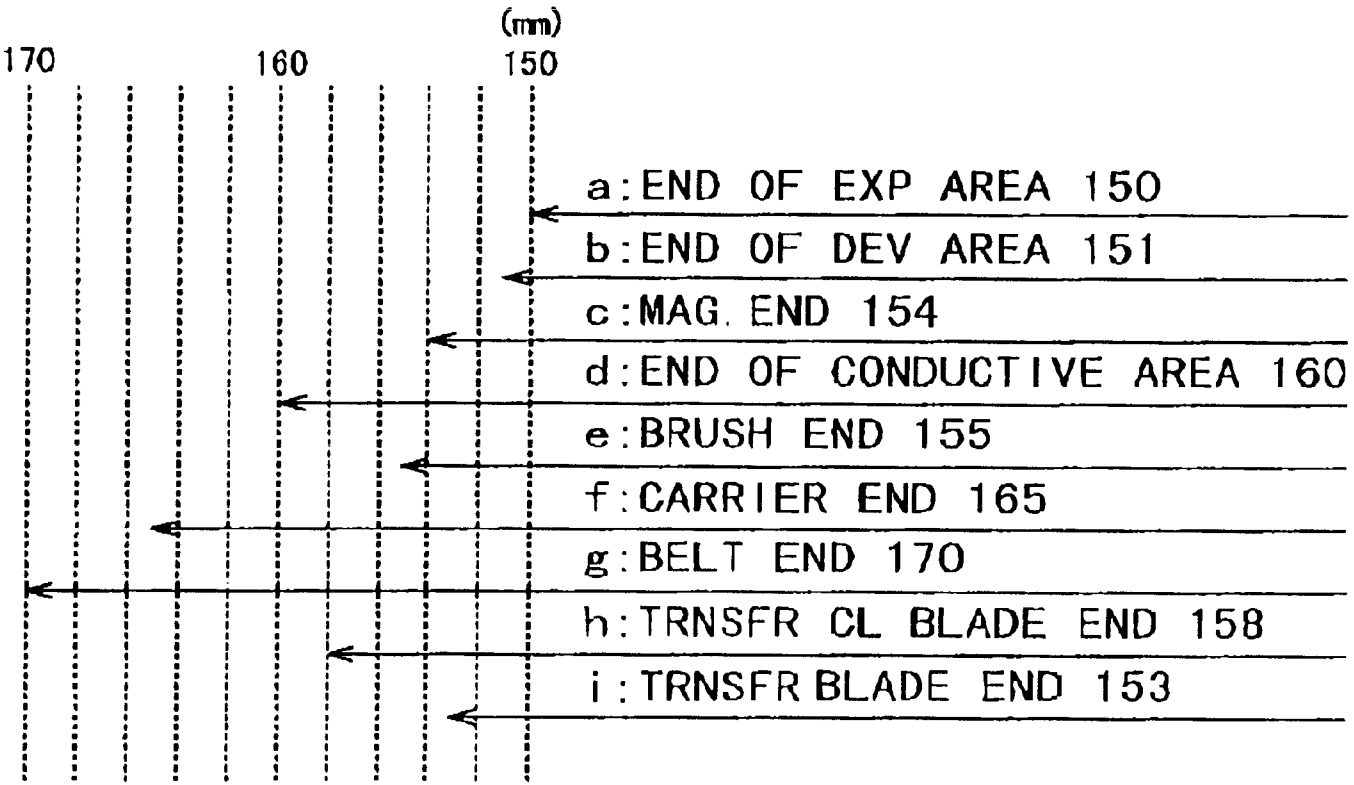
FIG. 9 is a chart for showing the positions of the edges of the various components.

FIG. 9 shows the positional relationship among the edges, in terms of the widthwise direction, of the various device and apparatuses: charging device, exposing apparatus, developing apparatus, transferring apparatus, and the like. The numbers represents the distances (in the base unit of mm) from the center of an image (center of the image formation area).

The edge b (151 mm) of the area of the development sleeve 4*b* for supplying developer, which is to be coated with the developer, is on the outward side relative to the edge a (150 mm) of the area of the photosensitive drum 1, across which image is written. The edge c (154 mm) of the magnet (magnetic roll) within the development sleeve, for holding the developer, needs to be on the outward side relative to the edge b of the area of the development sleeve 4*b* for supplying developer, which is to be coated with the developer.

A region in which there is a possibility that the charge carrier 2*d* in the magnetic brush portion 2*c* of the magnetic brush type charging device 2A will adhere to the photosensitive drum 1 across the region corresponding to the coated portion of the charge sleeve 2*b* is the region from the edge d (160 mm) of the electrically conductive region of the charge sleeve 2*b* to the edge f (165 mm) of the charge carrier coated area of the charge sleeve 2*b*. Therefore, the charge carrier adhering to the longitudinal end portions of the photosensitive drum 1 can be prevented from adhering to the development sleeve 4*b*, by making such an arrangement that the edge d of the electrically conductive region of the charge sleeve 2*b*, and the edge f of the charge carrier coated region of the charge sleeve 2*b* are positioned on the outward side relative to the edge c of the magnet in the development sleeve of the development apparatus 4. In other words, the edge of the region of the charge sleeve, which is to be coated with the charge carrier, is positioned on the outward side relative to the region of the development sleeve, across which a magnetic field is generated, so that the charge carrier which has adhered to the longitudinal end portions of the photosensitive drum 1 is not recovered by the developing apparatus 4. For the purpose of reducing the apparatus size, it is desired that the edge f of the coat region is positioned on the outward side relative to the edge c of the magnet, and on the inward side relative to the end of the development sleeve 4*b*.

Further, the edge f of the carrier coat region of the charge sleeve 2*b* must be on the outward side relative to the edge d of the electrically conductive region of the charge sleeve 2*b*, which is obvious.

Further, as disclosed in Japanese Laid-Open Patent Application No. 207186/1998, by making an arrangement so that the edge e (155 mm) of the electrically conductive brush 12 as a contact type charging member placed in contact with the photosensitive drum 1, between the transferring apparatus 5 and charging apparatus 2, is positioned between the edge b of the developer coat region of the development sleeve 4*b* and the edge d of the electrically conductive region of the charge sleeve 2*b*, the transfer residual toner can be recovered, while preventing the charge carrier from adhering to the region of the photosensitive drum, which has been charged to the positive polarity by the electrically conductive brush 12.

By positioning the edge g (170 mm) of the transfer belt on the outward side relative to the region in which there is a possibility that the charge carrier in the magnetic brush portion 2*c* on the charge sleeve 2*b* will adheres to the photosensitive drum 1 across the region correspondent to the coat portion of the charge sleeve 2*b*, that is, the region from the edge d (160 mm) of the electrically conductive region of the charge sleeve 2*b* to the edge f (165 mm) of the charge carrier coated area of the charge sleeve 2*b*, the charging carrier which has adhered to the photosensitive drum 1 can be prevented from falling on to the transfer blade 5*d* or the portion for supplying the transfer blade 5*d* with electrical power, which are located below the transfer belt 5*a*. Therefore, transfer failure traceable to transfer bias leak can be prevented. In other words, by positioning the edge of the transfer belt 5*a* of the transferring apparatus 5 on the outward side relative to the edge of the region of the charge sleeve, which is to be coated with the charge carrier, the transfer bias leak can be prevented while preventing the charge carrier, while falls from the end portion of the peripheral surface of the photosensitive drum, from falling onto the transfer bias applying portion.

Further, by positioning the edge of the transfer belt of the transferring apparatus on the outward side relative to the end of the charge sleeve, the charge carrier which leaks from the end portions of the magnetic brush type charging device can be also dropped onto the transfer belt, to prevent it from reaching the transfer charging device.

After falling onto the transfer belt 5*a*, the charge carrier falls into the transfer belt cleaner shell (edge position: 200 mm). If the edge g of the transfer belt is on the inward side relative to the edge f of the charge carrier coat region, a cover may be placed above the transfer charging device. However, it is extremely difficult to eliminate the gap between the transfer belt being driven, and the cover, and therefore, it is difficult to completely prevent the magnetic carrier from falling onto the transfer charging device.

Further, by positioning the edge h (158 mm) of the transfer belt cleaning blade on the inward side relative to the edge d of the electrically conductive region of the charge sleeve 2*b*, the charge carrier which did not fall into the transfer belt cleaner housing, and has adhered to the surface of the transfer belt, can be prevented from sticking between the transfer belt cleaning blade 3*e* and transfer belt 5*a*, and chipping the blade edge or damaging the transfer belt. In other words, in the case of an image forming apparatus in which the cleaning member for the transfer belt 5*a* is only the cleaning blade 5*e*, the cleaning blade and transfer belt can be prevented from being damaged, by positioning the edge of the blade on the inward side relative to the region of the charge sleeve, which is to be coated with the charge carrier.

Further, the toner which has adhered to the transfer belt 5*a* can be removed by positioning end portion h of the transfer belt cleaning blade on the outward side relative to the edge i (153 mm) of the transfer blade 5*d*, which is correspondent to the region of the transfer belt 5*a*, where the toner may reach.

The edge i of the transfer blade must be on the outward side relative to the edge of the exposure region, which is obvious.

Figure 10:
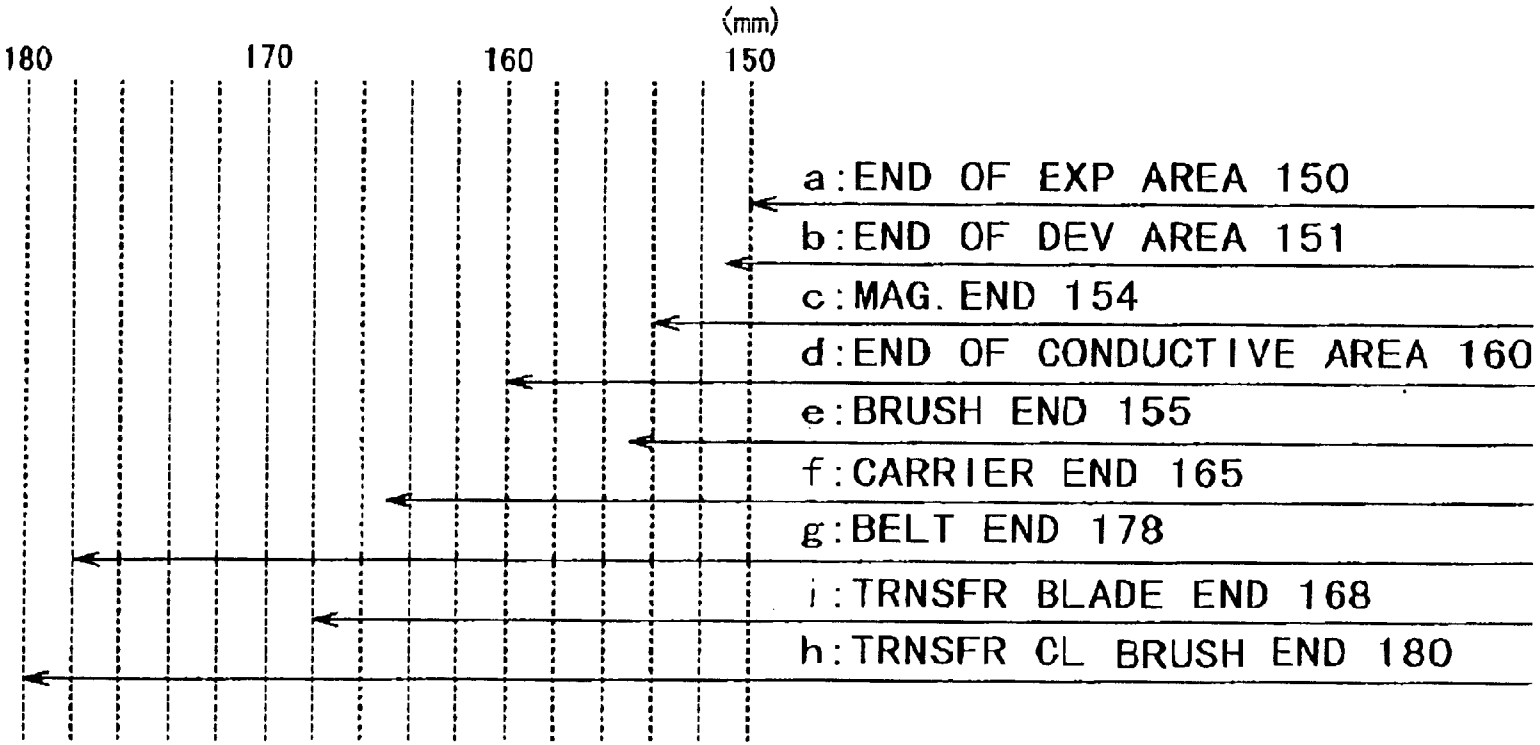
FIG. 10 is a chart for showing the positions of the edges of the various components in the second embodiment.

Embodiment 2 (FIG. 10)

In a cleaner-less process combined with an injection charging system, the transfer residual toner is expelled back onto the peripheral surface of the photosensitive drum 1 after being once recovered by the magnetic brush type charging device 2A. Therefore, if the charge carrier moves in the thrust direction in the magnetic brush type charging device 2A, there will be such toner that is not recovered by the developing apparatus even after being expelled out of the magnetic brush type charging device 2A, on the peripheral surface of the photosensitive drum, in the range between the edge b (151 mm) of the developer coat region of the development sleeve 4*b* and the edge f (165 mm) of the charge carrier coat region of the charging sleeve 2*b*. This kind of toner is to be recovered again by the magnetic brush type charging device 2A. However, in the range, correspondent to the adjacencies of the edge f of the charge carrier region of the charge sleeve 2*b*, in which the charge carrier coat is unstable, it is difficult for this kind of toner to be recovered, and therefore, it remains on the photosensitive drum.

In this embodiment, in order to recover this kind of toner which is difficult to recover, the edge i (168 mm) of the transfer blade is positioned on the outward side relative to the edge f (165 mm) of the charge carrier coat region of the charge sleeve 2*b* as shown in FIG. 10.

In this case, there is a possibility that the charge carrier will adhere to the photosensitive drum, across the region correspondent to the edge portion of the charge carrier coat region of the charge sleeve 2*b*, and then will become stack between the transfer belt cleaning blade and transfer belt.

In this embodiment, in order to eliminate the above possibility, a cleaning fur brush was employed as the cleaning member for the transfer belt 5*a*. The cleaning fur brush is rotated in the direction counter to the rotational direction of the transfer belt 5*a*, to remove the charge carrier and toner adhering to the transfer belt 5*a*. The edge h (180 mm) of the fur brush is desired to be on the outward side relative to the edge f of the charge carrier coat region of the charge sleeve 2*b*, preferably on the outward side relative to the edge g (178 mm) of the transfer belt.

Figure 11:
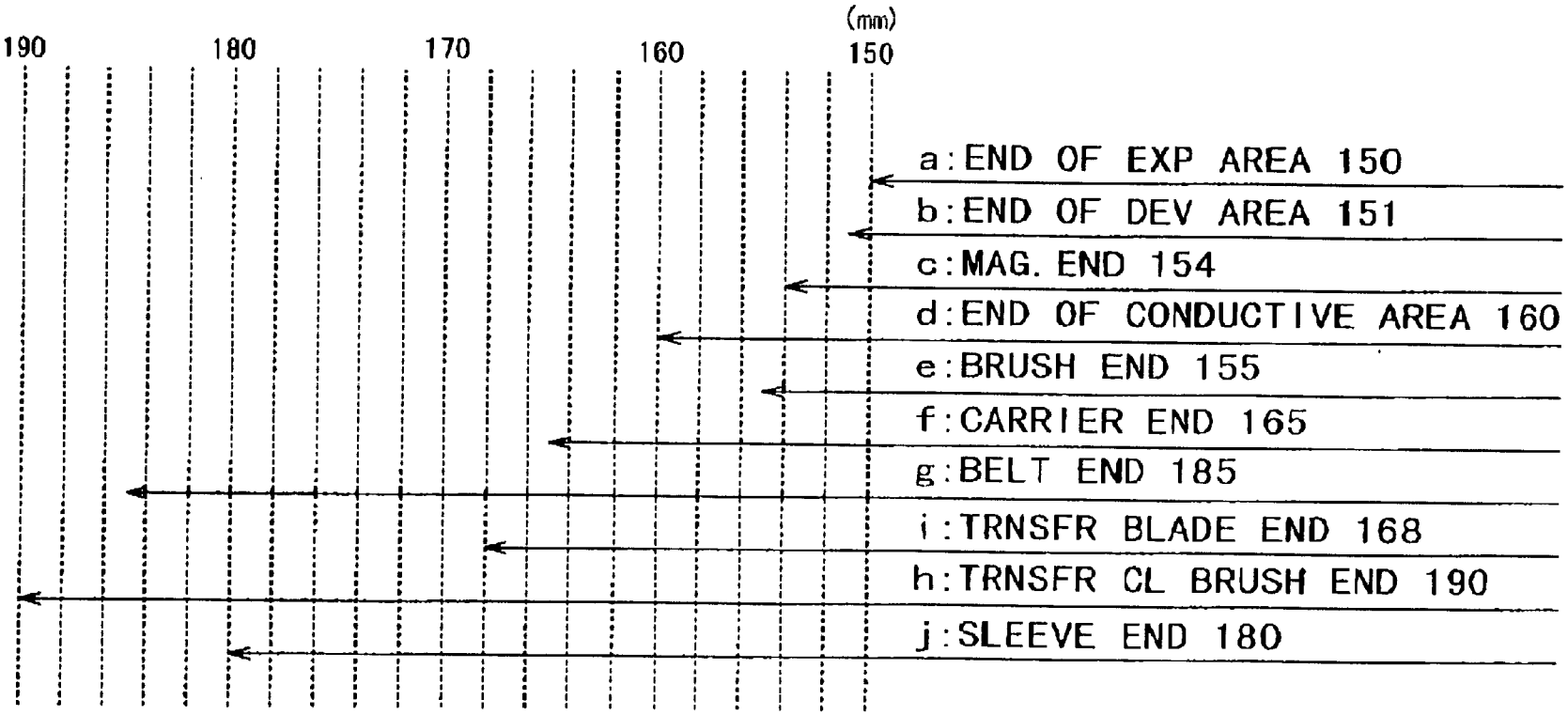
FIG. 11 is a chart for showing the positions of the edges of the various components in the third embodiment.

Embodiment 3 (FIG. 11)

In this embodiment, in order to prevent charge carrier from spilling outward of the charge carrier coat region of the magnetic brush type charging device 2A, a method, in which a magnetic shield, or an elastic member formed of felt or foamed urethane, is placed in contact with the charge sleeve 2*b*, as is known regarding a developing apparatus which employs two component developer, is employed.

However, if there is continuous force which acts on charge carrier in a manner to move it outward of the charge carrier region, due to the high compression of charge carrier, charge carrier spills out of the charge carrier coat region. In this situation, without the presence of a magnet in the charge sleeve 2*b*, charge carrier falls off from the end of the charging device shell, because there is no magnetic force which confines charge carrier. Thus, in this embodiment, in order to prevent the transfer failure traceable to the falling of charge carrier onto the transfer charging device, the edge g (185 mm) of the transfer belt was positioned on the outward side relative to the edge j (180 mm) of the charge sleeve.

With this arrangement, the charge carrier which fell off from the edge j of the charge sleeve can be caught by the transfer belt 5*a*, to prevent the charge carrier from reaching the transfer charging device 5*d*.

The edge f (190 mm) of the transfer belt cleaning fur brush is desired to be on the outward side relative to the charge sleeve edge j. Preferably, it is desired to be on the outward side relative to the transfer belt edge g, because such an arrangement makes it possible to remove all the charge carrier and toner on the surface of the transfer belt, contributing to the formation of better images.

Figure 12:
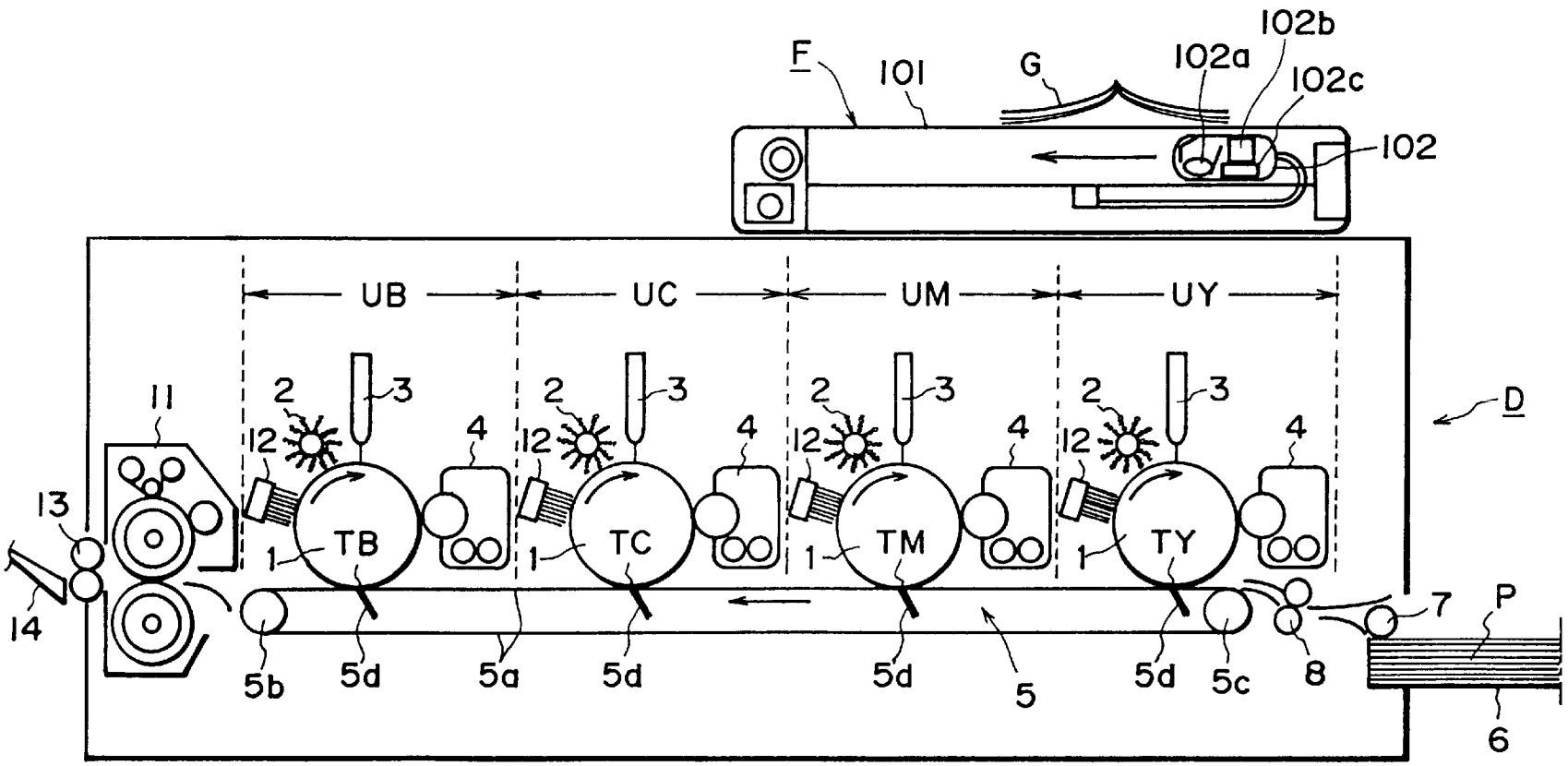
FIG. 12 is schematic sectional view of a full-color image forming apparatus in a fourth embodiment of the invention, and depicts the general structure of the apparatus.

Embodiment 4 (FIG. 12)

The image forming apparatuses mentioned in the preceding embodiments from a monochromatic image. However, if plural sets of a photosensitive member, a charging device, a developing device, and the like (plural image formation units) are disposed along a single transfer belt, or an intermediary transfer medium different from a transfer belt, to sequentially transferring toner images of different color onto transfer medium, it is possible to form a full-color image or a multicolor image. The present invention is also applicable to such an image forming apparatus, which is obvious.

FIG. 12 shows an example of such an image forming apparatus. The image forming apparatus in this embodiment is a full-color image forming apparatus which employs a transfer type electrophotographic process, an injection charging method, a reversal development method, a cleaner-less system, and a tandem method. A referential code D designates a printer portion, and a referential code F designates a color image reading apparatus (color image reader) placed on top of the printer portion D.

(1) Color Image Reading Apparatus F

In the color image reading apparatus F, a referential code 101 designates an original placement platen (transparent plate formed of glass or the like). An original G is placed on this original placement platen, with the side to be copied facing downward, and the original is covered with an unillustrated original pressing plate placed across the platen; the original is set.

A referential code 102 designates a color image reading unit which comprises an original illumination lamp 102*a*, a short focal point lens array 102*b*, a CCD sensor 102, and the like. As a copy start signal is inputted, this unit 102 is driven along the bottom surface of the original placement platen 101, starting from the home position, that is, the right-hand side end, toward the left-hand side end, and as it reaches the end of the predetermined range, it is driven back to the original position, or the home position.

During the leftward movement of this unit 102, the image on the downwardly facing surface of the original G set on the original placement platen is illuminated by light in a manner to continuously scan the downwardly facing surface, starting the right-hand end toward the left-hand end. As the light sans, it is reflected by the downwardly facing surface of the original, and is focused on the CCD sensor 102 by the short focal point lens array 102*b*.

The CCD sensor 102*c* comprises a light receiving portion capable of color separation, a transfer portion, and an output portion. In the color separating light receiving portion, the original image is separated into plural images of primary colors, and the primary colors, which constitute optical signals, are converted into signals in the form of electrical charge, which are sequentially transferred, in synchronism with clock pulses, into the output portion, through the transfer portion. In the output portion, the signals in the form of electrical charge are converted into signals in the form of electrical voltage, are amplified, are reduced in impedance, and then are outputted. The signals obtained through the above described process, that is, the analog signals, are put through a known image forming process, converted into digital signals, and sent to the printer portion D.

In other words, the image data of the primary color images obtained by chromatically separating the color original G are photoelectrically read as sequential electric digital picture element signals by the color image reading apparatus F.

The original G may be monochromatic. In such a case, the data of a monochromatic image are photoelectrically read as sequential electric digital picture element signal s.

(2) Printer Portion D

Designated by referential codes UY, UM, UC and UB are four image formation units (image forming means, image formation stations): first to fourth units arranged in this order in the printer D, in the right to left direction.

In this embodiment, the first image formation unit UY is an yellow image formation unit; the second image formation unit UM is a magenta image formation unit; the third image formation unit UC is a cyan image formation unit; and the fourth image formation unit UB is a black image formation unit.

Each of the first to fourth image formation units UY, UM, UC and UB comprises a photosensitive drum 1 as an image beating member, a magnetic brush type charging apparatus 2, an LED array 3 as an image exposing means, a developing apparatus 4, and a fur brush 12 as an auxiliary contact type charging member.

A referential code 5 designates a transfer belt apparatus disposed approximately horizontally in the left to right direction, along the bottom sides of the first to fourth image formation units. It comprises an endless belt 5*a* suspended and stretched between a driver roller 5*b*, or the roller on the left-hand side, and a follower roller 5*c*, or the roller on the right-hand side. The endless belt 5*a* is rotatively driven in the clockwise direction indicated by an arrow mark. On the inward side of the loop of the endless belt 5*a*, four transfer charge blades 5*d* are disposed, which apply pressure upon the transfer belt 5*a*, at the points correspondent to the image formation units UY, UM, UC and UB, so that the top loop side of the transfer belt 5*a* is kept pressed upon the bottom portion of the photosensitive drum 1, to form and maintain first to fourth transfer nips TY, TM, TC and TB.

A plurality of sheets of transfer medium P (recording medium) stored in a sheet feeder cassette 6 are fed out one by one by a sheet feeder roller 7,and is released by a registration roller 8, onto the endless belt 5*a* of the transfer belt apparatus 5, on the portion running on the top side, with predetermined control timing.

After being fed onto the belt 5*a*, the transfer medium P is held on the belt surface, using electrostatic force, or chucks or the like. As the belt 5*a* is rotationally driven, the transfer medium P is sequentially conveyed through the first to fourth transfer nips TY, TM, TC and TB. In the first transfer nip TY, an yellow toner image on the photosensitive drum 1 of the first image formation unit UY is transferred onto the transfer medium P: in the second transfer nip TM, a magenta toner image on the photosensitive drum 1 of the second image formation unit UM is transferred onto the transfer medium P; in the third transfer nip TC, a cyan toner image on the photosensitive drum 1 of the third image formation unit UC is transferred onto the transfer medium P; and in the fourth transfer nip TB, a black toner image on the photosensitive drum 1 of the fourth image formation unit UB is transferred onto the transfer medium P. In other words, a total of four toner images are transferred in layers onto the same transfer medium P. As a result, a full-color image of the original is synthetically formed.

The toner image formation in each of the image formation units UY, UM, UC and UB is carried out with predetermined synchronized timing, so that the toner images formed in the image formation units UY, UM, UC and UB are sequentially transferred in aligned layers onto the predetermined area of the same transfer medium P conveyed by the transfer belt apparatus 5.

Not only do the transfer blades 5*d* apply pressure upon the top loop portion of transfer belt 5*a*, at the points corresponding to the image formation units UY, UM, UC and UB, so that the transfer belt 5*a* is pressed upon the bottom portion of the photosensitive drum 1, to form the first to fourth transfer nips TY, TM, TC and TB, but also charge the transfer medium P to the polarity opposite to the toner polarity from the bottom side of the transfer medium P as the transfer bias is applied from an unillustrated transfer bias application electrical power source. As a result, the toner images on the rotational photosensitive drum 1 are sequentially and electrostatically transferred onto the transfer medium P which are conveyed through the transfer nips TY, TM, TC and TB.

After being conveyed through the fourth transfer nip TB, that is, the last transfer nip, by the transfer belt 5*a*, the transfer medium P is separated from the transfer belt 5*a*, and is introduced into a thermal fixing apparatus 11. The thermal fixing apparatus 11 in this embodiment is a thermal roller type fixing apparatus. As the transfer medium is conveyed through the fixing nip portion of this thermal roller type fixing apparatus 11, while being pinched by the thermal rollers, the unfixed full-color toner image on the surface of the transfer medium is fixed by heat and pressure to the transfer medium P; it becomes a permanently fixed image.

After the toner image is fixed to the transfer medium by the thermal fixing apparatus 11, the transfer medium is discharged by a sheet discharge roller 13 into an external delivery tray 14.

When in a monochromatic mode, only the fourth image formation unit UB, that is, the black image forming means, among the above described first to fourth image formation units UY, YM, YC and UB, is activated to form a black toner image on the photosensitive drum 1 of this image formation unit, and this black toner image is transferred onto the transfer medium P conveyed by the transfer belt apparatus 5. Then, the transfer medium P is passed through the thermal fixing apparatus 11 and discharge roller 13 to be discharged into the delivery tray 14.

An intermediary transfer member may be employed in place of the transfer belt 5*a*. In such a case, the toner images from the image formation units UY, UM, UC and UB are sequentially and directly transferred in layers onto the intermediary transfer member with predetermined synchronous timing, and then, the toner images on the intermediary are transferred all at once onto the transfer medium P.

Miscellaneous Embodiments

1) The choice of the magnetic brush type charging device 2A does not need to be limited to a sleeve rotation type. For example, it may be of a type in which a magnetic roll rotates. In such a case, the surface of a magnetic roll is treated to give it electrical conductivity to use the magnetic roll as a power supply electrode as needed, and electrically conductive charge carrier is directly held on the peripheral surface of this magnetic roll by the magnetic force to form a magnetic brush portion as this magnetic roll is rotated. Further, a nonrotational magnetic brush type charging member may be employed.

2) From the viewpoint of charge injection and prevention of ozone generation, it is desired that a photosensitive drum as an image bearing member is provided with a surface layer, the surface resistance of which is in a low range of $10^9$–$10^{14}$ ohm.cm. An image bearing member may be an organic photosensitive member or the like, instead of the above described one. In other words, the choice of a contact type charging method does not need to be limited to the charge injection type charging method employed in the preceding embodiments; it may be a such a contact type method that principally depends on electrical discharge.

3) In the preceding embodiments, only two component developing method was mentioned regarding the developing apparatus. However, other development methods may be used. In order to enhance the simultaneous recovery process, single component contact type developing methods or two component contact type developing methods, in which a latent image is developed by placing developer in contact with a photosensitive drum, are preferable.

Further, when polymer toner particles are used as the toner particles in the developer, not only the above described single component contact type developing methods and two component contact type developing methods, but also single component noncontact type developing methods or two component noncontact type developing methods, may be used to satisfactorily enhance the recovery process.

The developing method employed by a developing apparatus may be a reversal type developing method or a normal developing method.

4) An image forming apparatus does not need to be of a cleaner-less type. It may be of a type equipped with a dedicated cleaning apparatus for removing the transfer residual toner from the peripheral surface of an image bearing member after image transfer.

5) As for the wave-form of AC (alternating voltage, alternating current voltage), a sinusoidal wave-form, a rectangular wave-form, a triangular wave-form, or the like, may be optionally used. It may be a rectangular wave-form created by periodically turning on and off a DC power source. In other words, any alternating voltage, the voltage value of which periodically changes, may be used as the alternating component of bias.

6) An image exposing means for forming an electrostatic latent image does not need to be limited to a laser based scanning exposing means which forms a digital latent image as in the preceding embodiments. It may be an analog image exposing means, or a light emitting element such as LED. Further, it may be a combination of a light emitting element, such as a fluorescent lamp, and a liquid crystal shutter. In other words, any image exposing means may be employed as long as it is capable of forming an electrostatic latent image in accordance with image data.

An image bearing member may be an electrostatically recordable dielectric member or the like. In such a case, the surface of the dielectric member is uniformly charged (primary charge) to predetermined polarity and potential level, and then, the electrical charge is selectively removed with the use of a charge removing means such as an electron gun, to write an electrostatic latent image of an intended image.

7) The choice of a transferring means does not need to be limited to the transfer belt apparatus in the preceding embodiments. A corona discharge type transferring apparatus, a roller type transferring apparatus, a blade type transferring apparatus, or the like may be optionally chosen.

8) The processing devices such as the image bearing member 1, charging apparatus 2, developing apparatus 4, and the like, may be integrated, in an optional combination, in the form of a process cartridge, so that they can be installed into, or removed from, the main assembly of an image forming apparatus, all at once.

9) There is an image displaying apparatus which displays a toner image across its display portion. In such an apparatus, An electrophotographic photosensitive member or an electrostatically recordable dielectric member, as an image bearing member, is in the form of a rotational belt, for example, and a toner image in accordance with image data is formed on the rotational belt through a charging process, an electrostatic latent image forming process, a developing process, and the like. An image formed on the rotational belt is positioned in alignment with a display portion so that the image can be seen or read through the display portion. The image bearing member is repeatedly used to display images. The image forming apparatuses to which the present invention is applicable includes this type of an image display apparatus.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus comprising:

an image bearing member;

a charging means for electrically charging said image bearing member, said charging means including a particle carrying member for receiving a charging bias voltage and for carrying electroconductive magnetic particles, said particle carrying member being provided with an electrically insulating portion at an end portion within a region in which the magnetic particles are carried;

electrostatic image forming means for forming an electrostatic image on said image bearing member charged by said charging means; and developing means for developing the electrostatic image on said image bearing member, said developing means including a developer carrying member for carrying a magnetic developer and a magnetic field generating means provided in said developer carrying member, wherein a longitudinally inside end of said electrically insulating portion is outside a longitudinal end of said magnetic field generating means.

2. An apparatus according to claim 1, wherein said developer carrying member is longer than said magnetic field generating means, and said electrically insulating portion overlaps said developer carrying member.

3. An apparatus according to claim 1, wherein said magnetic field generating means extends beyond a developer carrying region of said developer carrying member.

4. An apparatus according to claim 1, wherein said developing means includes non-magnetic toner and carrier constituting the magnetic developer.

5. An apparatus according to claim 1, wherein said particle carrying member includes an electroconductive sleeve, and wherein said electrically insulating portion is provided by an insulating treatment imparted at the end portion.

6. An image forming apparatus comprising:

an image bearing member;

charging means for electrically charging said image bearing member, said charging means including a particle carrying member for receiving a charging bias voltage and for carrying electroconductive particles;

toner image forming means for forming a toner image on said image bearing member;

an image transfer belt onto which the toner image is transferred directly or through a transfer material; and a transfer charger provided in a movement path of said image transfer belt, wherein said image transfer belt has a width, which is larger than a particle carrying region of said particle carrying member.

7. An apparatus according to claim 6, wherein said particle carrying member has an electrically insulating portion at an end portion of the particle carrying region.

8. An apparatus according to claim 7, further comprising a cleaning blade for cleaning a surface of said image transfer belt, wherein an inner end of said electrically insulating portion is outside an end of said cleaning blade.

9. An apparatus according to claim 6, further comprising a cleaning brush for cleaning a surface of said image transfer belt, wherein said cleaning brush is longer than the particle carrying region.

10. An apparatus according to claim 6, wherein said transfer charger includes a transfer blade urging said image transfer belt.

11. An image forming apparatus comprising:

an image bearing member;

charging means for charging said image bearing member, said charging means including a particle carrying member for receiving a charging bias voltage and for carrying electroconductive particles, wherein said charging means temporarily stores residual toner from said image bearing member;

electrostatic image forming means for forming an electrostatic image on said image bearing member;

developing means for developing the electrostatic image on said image bearing member;

image transfer means for transferring a toner image from said image bearing member onto a transfer material; and charge application means for applying an electric charge having a polarity opposite from a polarity provided by said charging means to residual toner on said image bearing member remaining after image transfer by said transfer means, wherein a particle carrying region of said particle carrying member is wider than a charge application region of said charge application means.

12. An apparatus according to claim 11, wherein said particle carrying member is provided with an electrically insulating portion at an end portion in the particle carrying region, and the inner end of the electrically insulating portion is outside the charge application region.

13. An apparatus according to claim 11, wherein the residual toner having received the electric charge applied by said charge application means is collected by said charging means.

14. An apparatus according to claim 11, wherein said charging means returns the toner onto said image bearing member, and said developing means collects the toner returned by said charging means.

* * * * *

UNITED STATES PATENT AND TRADEMARK OFFICE

CERTIFICATE OF CORRECTION

PATENT NO. : 6,393,238 B1
DATED : May 21, 2002
INVENTOR(S) : Kouichi Hashimoto et al.

It is certified that error appears in the above-identified patent and that said Letters Patent is hereby corrected as shown below:

Title page,
Item [57], ABSTRACT,
Line 5, "electroconducsctive" should read -- electroconductive --; and
Line 8, "electrectrostatic" should read -- electrostatic --.

Column 1,
Line 11, "a" should read -- an --; and
Line 18, "charged" should read -- charge --.

Column 2,
Line 36, "not shown." should read -- (not shown). --; and
Line 61, "insulating" should read -- insulating treatment --.

Column 3,
Line 8, "voltage a leak" should read -- voltage leaks --;
Line 18, "of a" should read -- of an --;
Line 38, "advantage" should read -- advantages --;
Line 56, "change" should read -- charge --; and
Line 58, "changes" should read -- charge --.

Column 4,
Line 7, "is" should read -- is a --; and
Line 21, "Injection" should read -- injection --.

Column 5,
Line 7, "an" should be deleted; and
Line 29, "conveyer" should read -- conveyor --.

Column 6,
Line 28, "active" should read -- activate --;
Line 40, "he" should read -- the --; and
Line 58, "period" should read -- periods --.

Column 7,
Line 5, "competed" should read -- completed --;
Line 14, "periods" should read -- period --;
Line 18, "image" should read -- images --;
Line 28, "if," should read -- 1f, --; and
Line 33, "smoothing" should read -- smooth --.

UNITED STATES PATENT AND TRADEMARK OFFICE

CERTIFICATE OF CORRECTION

PATENT NO. : 6,393,238 B1
DATED : May 21, 2002
INVENTOR(S) : Kouichi Hashimoto et al.

It is certified that error appears in the above-identified patent and that said Letters Patent is hereby corrected as shown below:

Column 8,
Line 60, "he" should read -- the --.

Column 9,
Line 3, "form" should read -- to form --; and
Line 63, "he" should read -- the --.

Column 10,
Line 11, "are" should read -- is --; and
In formula 1, "$Vd=V_o(1-\exp(t_0/Cp.r)$" should read -- $Vol=V_0\ (1-\exp(t_0/Cp.r))$ --.

Column 11,
Line 6, "given" should read -- giving --; and
Line 42, "designate" should read -- designated --.

Column 13,
Line 30, "carrier c" should read -- carrier c) --.

Column 14,
Line 56, "high-in" should read -- high in --.

Column 15,
Line 13, "he" should read -- the --;
Line 15, "extend" should read -- extended --;
Line 20, "for electrically insulate" should read -- to electrically insulate --;
Line 49, "device" should read -- devices --; and
Line 52, "represents" should read -- represent --.

Column 16,
Line 43, "adheres" should read -- adhere --;
Line 50, "on to" should read -- onto --; and
Line 59, "while" should read -- which --.

Column 17,
Line 63, "stack" should read -- stuck --.

Column 18,
Line 41, "from" should read -- form --.

UNITED STATES PATENT AND TRADEMARK OFFICE

CERTIFICATE OF CORRECTION

PATENT NO. : 6,393,238 B1
DATED : May 21, 2002
INVENTOR(S) : Kouichi Hashimoto et al.

It is certified that error appears in the above-identified patent and that said Letters Patent is hereby corrected as shown below:

Column 19,
Line 15, "sans," should read -- scans, --;
Line 40, "signal s." should read -- signals. --; and
Line 54, "beating" should read -- bearing --.

Column 20,
Line 7, "7,and" should read -- 7, and --.

Column 21,
Line 2, "YM, YC" should read -- UM, UC --; and
Line 37, "be a" should read -- be --.

Column 22,
Line 33, "An" should read -- an --.

Signed and Sealed this

First Day of October, 2002

*Attest:*

*Attesting Officer*

JAMES E. ROGAN
*Director of the United States Patent and Trademark Office*